US006443826B1

(12) United States Patent
Yang et al.

(10) Patent No.: US 6,443,826 B1
(45) Date of Patent: Sep. 3, 2002

(54) POLISHING HEAD OF A CHEMICAL MECHANICAL POLISHING APPARATUS AND, RETAINER RING OF THE SAME

(75) Inventors: Yun-Sik Yang; Hun Cha; Kyung-dae Kim; Min-gyu Kim, all of Suwon (KR)

(73) Assignee: Samsung Electronics Co., Ltd., Suwon (KR)

( * ) Notice: Subject to any disclaimer, the term of this patent is extended or adjusted under 35 U.S.C. 154(b) by 37 days.

(21) Appl. No.: 09/594,469

(22) Filed: Jun. 20, 2000

(30) Foreign Application Priority Data

Jun. 22, 1999 (KR) ..... 99-23490

(51) Int. Cl.[7] ..... B24B 47/00

(52) U.S. Cl. ..... 451/388; 451/288; 451/289

(58) Field of Search ..... 451/287, 288, 451/289, 290, 388, 397, 398, 442

(56) References Cited

U.S. PATENT DOCUMENTS 6,183,350 B1 * 2/2001 Lin et al. ..... 451/41
6,241,582 B1 * 6/2001 Lin et al. ..... 451/41

FOREIGN PATENT DOCUMENTS

JP 9-234664 9/1997
JP 9-295263 11/1997

* cited by examiner

*Primary Examiner*—Timothy V. Eley
(74) *Attorney, Agent, or Firm*—Volentine Francos, PLLC

(57) ABSTRACT

A retainer ring of a polishing head of a CMP apparatus facilitates the removal of contaminants, such as slurry debris, which have found their way into the polishing head. The retainer ring includes an annular ring body, and a plurality of contaminant outlets extending from the inner peripheral surface of the ring body to the outer peripheral surface of the ring body. Inner openings defined at the inner peripheral surface of the ring body and outer openings defined at the outer peripheral surface of the ring body by the contaminant outlets are horizontally elongated slots. Also, each of the contaminant outlets consists of a plurality of inner holes and an outer hole which is joined to the plurality of inner holes. The contaminant outlets occupy at least 30% of the radially innermost peripheral surface along a line extending circumferentially along the surface. The CMP apparatus itself includes a polishing head having such a retainer ring and a washing unit having a nozzle for spraying deionized water through the contaminant outlets of the retainer ring toward an inner space formed in the polishing head.

14 Claims, 18 Drawing Sheets

POLISHING HEAD OF A CHEMICAL MECHANICAL POLISHING APPARATUS AND, RETAINER RING OF THE SAME

BACKGROUND OF THE INVENTION

1. Field of the Invention

The present invention relates to a chemical mechanical polishing apparatus used in manufacturing a semiconductor device. More particularly, the present invention relates to a polishing head, and to the retainer ring of a polishing head of such a chemical mechanical polishing apparatus.

2. Description of the Related Art

Increasing the integration of semiconductor devices has required sequentially depositing multiple layers on a wafer. Accordingly, the semiconductor manufacturing process must include steps for planarizing each layer formed on the semiconductor wafer. Chemical mechanical polishing (CMP) is a typical process used for this purpose. In fact, CMP is well-suited for use in connection with large-diameter wafers because CMP produces excellent uniformity in planarizing wide areas in addition to narrow ones.

The CMP process makes use of mechanical friction and a chemical agent for finely polishing a wafer surface, such as that comprising tungsten or an oxide. In the mechanical aspect of such polishing, a wafer is placed on a rotating polishing pad and is rotated while a predetermined is load applied thereto, whereby the wafer surface is polished by the friction created between the polishing pad and the wafer surface. In the chemical aspect of such polishing, the wafer surface is polished by a chemical polishing agent, referred to as slurry, supplied between the polishing pad and the wafer.

A conventional CMP apparatus will now be described in with reference to FIG. 1. The conventional CMP apparatus includes a base 100, polishing pads 2120*a,* 210*b* and 210*c* installed on the base 100, a load-cup 300 for loading/unloading wafers, and a head rotation unit 400 having a plurality of polishing heads 410*a,* 410*b,* and 410*d* for holding the wafers and fixedly rotating the same on the polishing pads 210*a,* 210*b* and 210*c.*

In general, the CMP apparatus is provided with three polishing pads 210*a,* 210*b* and 210*c* so that a plurality of wafers can be processed in a short time. Each of the polishing pads 210*a,* 210*b* and 210*c* is closely fixed on a rotatable carousel (not shown). Pad conditioners 211*a,* 211*b* and 211*c* for controlling the surface states of the polishing pads 210*a,* 210*b* and 210*c* and slurry supplying arms 212*a,* 212*b* and 212*c* for supplying slurry to the surfaces of the polishing pads 210*a,* 210*b* and 210*c* are provided in the vicinity of the polishing pads 210*a,* 210*b* and 210*c.*

Also, the load-cup 300 includes a circular pedestal 310 on which the wafers are placed. The bottom surfaces of the polishing heads 410*a,* 410*b,* 410*c* and 410*d* and the top surface of the pedestal 310 are washed at the load-cup 300, as will be described later in more detail.

The head rotation unit 400 includes four polishing heads 410*a,* 410*b,* 410*c* and 410*d* and four rotation shafts 420*a,* 420*b,* 420*c* and 420*d.* The polishing heads 410*a,* 410*b,* 410*c* and 410*d* hold wafers and apply a predetermined amount of pressure to the top surfaces of the polishing pads 210*a,* 210*b,* 210*c* and 210*d.* The rotation shafts 420*a,* 420*b,* 420*c* and 420*d* for rotating the polishing heads 410*a,* 410*b,* 410*c* and 410*d,* respectively, are mounted on a frame 401 of the head rotation unit 400. A driving mechanism for rotating the rotation shafts 420*a,* 420*b,* 420*c* and 420*d* is provided within the frame 401 of the head rotation unit 400. The head rotation unit 400 is supported by a rotary bearing 402 so as to be rotatable about the longitudinal axis of the rotary bearing 402.

The process performed by the CMP apparatus having the above-described configuration will now be described with reference to FIGS. 1 and 2. First, a wafer 10 transferred to the load-cup 300 by a wafer transfer apparatus (not shown) is placed on the surface of the pedestal 310 of the load-cup 300. Here, the wafer 10 is adhered by suction to the surface of the pedestal 310 so as not to move. Then, the wafer 10 is lifted by the pedestal 310 onto a polishing head 410 positioned above the pedestal 310. The wafer 10 is adhered by suction to the polishing head 410. The head rotation unit 400 is rotated to transfer the wafer 10 in such a state above the polishing pad 210*a* adjacent to the load-cup 300. Then, the polishing head 410 is lowered to tightly press the wafer 10 onto the polishing pad 210*a.* At this time, the polishing pad 210 a and the wafer 10 are rotated in the same direction while slurry is supplied therebetween, whereby the wafer 10 is polished. The wafer 10 is then transferred sequentially to the other polishing pads 210*b* and 210*c* and then to the load-cup 300 where it is placed on the pedestal 310. Thereafter, the wafer transfer apparatus transfers the wafer 10 placed on the pedestal 310 to a location outside the CMP apparatus.

Once the wafer 10 has been unloaded, the polishing head 410 descends towards the load-cup 300. In such a state, deionized water is sprayed to wash the bottom surface of the polishing head 410 and the top surface of the pedestal 310. When washing is completed, the polishing head 410 and the pedestal 310 are lifted again and a new wafer is transferred by the wafer transfer apparatus onto the pedestal 310.

Referring to FIGS. 3 and 4, in order to wash the bottom surface of the polishing head 410 and the top surface of the pedestal 310, the load cup 300 is provided with washing means comprising a first nozzle 331 and a second nozzle 332 for spraying deionized water within a washing basin 320 of the load-cup 300. The first nozzle 331 is oriented so as to spray deionized water toward the top surface of the pedestal 310 and the second nozzle 332 is oriented so as to spray deionized water toward a membrane 411 installed on the bottom surface of the polishing head 410. The membrane 411 allows a vacuum to act on the wafers and secure them to the polishing head 410. Three sets each of the first and second nozzles 331 and 332 are installed at equal angular intervals around the circumference of the pedestal 310. Three wafer aligners 340 for guiding wafers are installed within the washing basin 320 of the load-cup 300 at equal angular intervals around the circumference of the pedestal 310 to guide the wafers placed on the pedestal 310 into position.

The washing basin 320 is supported by a cylindrical support housing 350, and a flexible hose 336 for supplying deionized water to the first and second nozzles 331 and 332 is installed within the support housing 350. A washing fluid channel 337 for connecting the flexible hose 336 to the first and second nozzles 331 and 332 is provided within the washing basin 320.

A plurality of spray orifices 311 for spraying deionized water upwards are provided in the pedestal 310 for the purpose of washing the membrane 411. A lateral passageway 312 connected to the spray orifices 311 is provided in the pedestal 310. The lateral passageway 312 is connected to a vertical passageway 313 formed inside a tubular pedestal column 315 supporting the pedestal 310.

As described above, the load-cup 300 is responsible for washing the bottom surface of the polishing head 410 and the top surface of the pedestal 310 as well as for supporting wafers while they are loaded and unloaded onto and from the CMP apparatus. The washing step is very important in the CMP process. Contaminants such as slurry debris or polished silicon particles are unavoidably produced during the CMP process, and some of the contaminants may remain on the surface of the membrane 411 and/or the pedestal 310. The contaminants remaining on the surface of the membrane 411 and/or the pedestal 310 can generate micro-scratches on the surface of a wafer if the contaminants are transferred thereto when the wafer is loaded in the course of polishing. The micro-scratches may cause defects such as gate oxide leakage or gate line bridging in the semiconductor devices, which lowers the yield and reliability of the semiconductor devices. Thus, any contaminants remaining on the membrane 411 and/or the pedestal 310 must be removed by washing the same using deionized water.

However, such contaminants cannot be completely removed by the washing operation performed by the conventional CMP apparatus. This washing operation will now be described with reference to FIGS. 5 through 7.

FIG. 5 is a cross-sectional view of a polishing head 410 of the conventional CMP apparatus, FIG. 6 is a detailed diagram of a portion "A" of the polishing head encircled in FIG. 5, and FIG. 7 is a perspective view of a conventional retainer ring of the polishing head.

The polishing head 410 of the CMP apparatus holds a wafer thereto under a predetermined amount of pressure and rotates the wafer in such a state. More specifically, the wafer is held by a vacuum to the polishing head 410 while it is rotated. To this end, a vacuum line 419 is provided within the polishing head 410, and a membrane support plate 414 having a plurality of holes 415 communicating with the vacuum line 419 is installed at the bottom of the polishing head 410. A membrane pad 416 is fixed close to the bottom of the membrane support plate 414. The bottom of the membrane pad 416 and the outer surface of the membrane support plate 414 are surrounded by the membrane 411, which is made of a flexible material which comes into direct contact with wafers. The membrane 411 is fixed to the membrane support plate 414 by a membrane clamp 417. A retainer ring 412 for preventing wafers from deviating outwards during polishing is disposed at the lower outer edge of the polishing head 410, that is, at the perimeter of the membrane 411. Four purge holes 4121 are provided at the outer circumference of the retainer ring 412 at equal angular intervals. While a wafer is adhered to the membrane 411, air can enter/leave a small space 418, formed between the membrane support plate 414 and the retainer ring 412, via the purge holes 4121.

In the polishing head 410 having the structure described above, a narrow gap having a width (D) of about 0.254 mm is present between the membrane 411 and the retainer ring 412 so that the membrane 411 can be elevated with respect to the retainer ring 412 when a load is applied to a wafer. However, the slurry or contaminants produced during polishing are induced into the space 418 through the gap having the width D. The induced slurry or contaminants induced into the space 418 are not removed by the washing operation. In other words, the deionized water sprayed from the first and second nozzles 331 and 332 shown in FIG. 4 cannot wash the contaminants induced into the space 418 because of the directions in which they spray the water and because of the narrowness of the gap D. Also, as shown in FIG. 7, although four purge holes 4121 are provided in the retainer ring 412, the diameters thereof are at most 2 mm. Thus, the contaminants induced into the space 418 cannot be exhausted through the small purge holes 4121. Thus, the contaminants accumulate over time and solidify as moisture evaporates therefrom.

The solidified contaminants drop onto the surface of a polishing pad due to vertical movement of the membrane 411 or slight vibration of the polishing pad during polishing. The size of the contaminants which drop onto the surface of the polishing pad exceed several micrometers, whereby micro-scratches or even macro-scratches can be formed in the surface of a wafer.

As described above, contaminants such as polished silicon particles or slurry debris are not completely removed in the conventional CMP apparatus. Thus, the surfaces polished by the CMP apparatus can become scratched, thereby lowering the yield and reliability of semiconductor devices produced from the wafers polished by the CMP apparatus.

SUMMARY OF THE INVENTION

It is therefore an object of the present invention to provide a polishing head, and more specifically, a retainer ring of a polishing head, which facilitates the removal of contaminants, such as slurry debris, from within a polishing head of a CMP apparatus.

It is another object of the present invention to provide a CMP apparatus which can effectively wash away contaminants, such as slurry debris, from within a polishing head.

To achieve the first object, the present invention provides a retainer ring which includes an annular ring body, a plurality of screw holes provided at the top surface of the ring body for allowing the ring body to be fixed in place in the polishing head, and a plurality of contaminant outlets extending from the inner peripheral surface of the ring body to the outer surface of the ring body and configured to allow contaminants within the polishing head to be exhausted to the outside of the polishing head under the centrifugal force that is produced when the polishing head is rotated.

At least six of the contaminant outlets are provided at substantially equal angular intervals about the periphery of the ring body, and the sum of the widths of all of the inner openings of the contaminant outlets, as measured a in the circumferential direction of the ring body, is at least 30% of the inner circumference of the ring body.

To further facilitate the discharge of the contaminants, the inner openings defined at the inner surface of the ring body and the outer openings defined at the outer surface of the ring body by the contaminant outlets are in the form of horizontally elongated slots, and each outer opening is preferably wider than that of each inner opening.

Also, each of the contaminant outlets preferably consists of a plurality of inner holes and an outer hole which is joined to the plurality of inner holes. The bottom of the outer hole slopes downwardly toward the outer peripheral surface of the ring body.

Furthermore, the contaminant outlets may extend longitudinally at a predetermined angle with respect to the radial direction of the ring body in a direction opposite to the direction in which the polishing head rotates during the polishing operation.

The contaminant outlets double as purge holes through which air passes when the wafer is vacuum-chucked to the polishing head.

To achieve the second object, the present invention provides a chemical mechanical polishing (CMP) apparatus for planarizing the surface of a semiconductor wafer, the CMP apparatus includes not only a polishing head having a retainer ring provided with contaminant outlets extending from the inner peripheral surface of the ring body to the outer peripheral surface thereof, but also washing means for spraying deionized water radially through the contaminant outlets of the retainer ring toward an inner space formed in the polishing head.

The washing means may be in the form of at least three third nozzles spaced from one another along the inner circumference of the load-cup of the CMP apparatus. Furthermore, an annular deionized water supply line may be installed along the inner surface of the load-cup, and the third nozzles are disposed in the deionized water supply line. The number of third nozzles is preferably the same as the number of contaminant outlets.

According to the present invention, the contaminants, such as slurry debris, which potentially could scratch the surface of a wafer, can be effectively washed or exhausted from the polishing head, thereby reducing defects in the semiconductor devices produced due to scratching.

BRIEF DESCRIPTION OF THE DRAWINGS

The above and other objects, features and advantages of the present invention will become more apparent from the following detailed description of a preferred embodiment thereof made with reference to the attached drawings, of which.

DETAILED DESCRIPTION OF THE PREFERRED EMBODIMENTS

Figure 1:
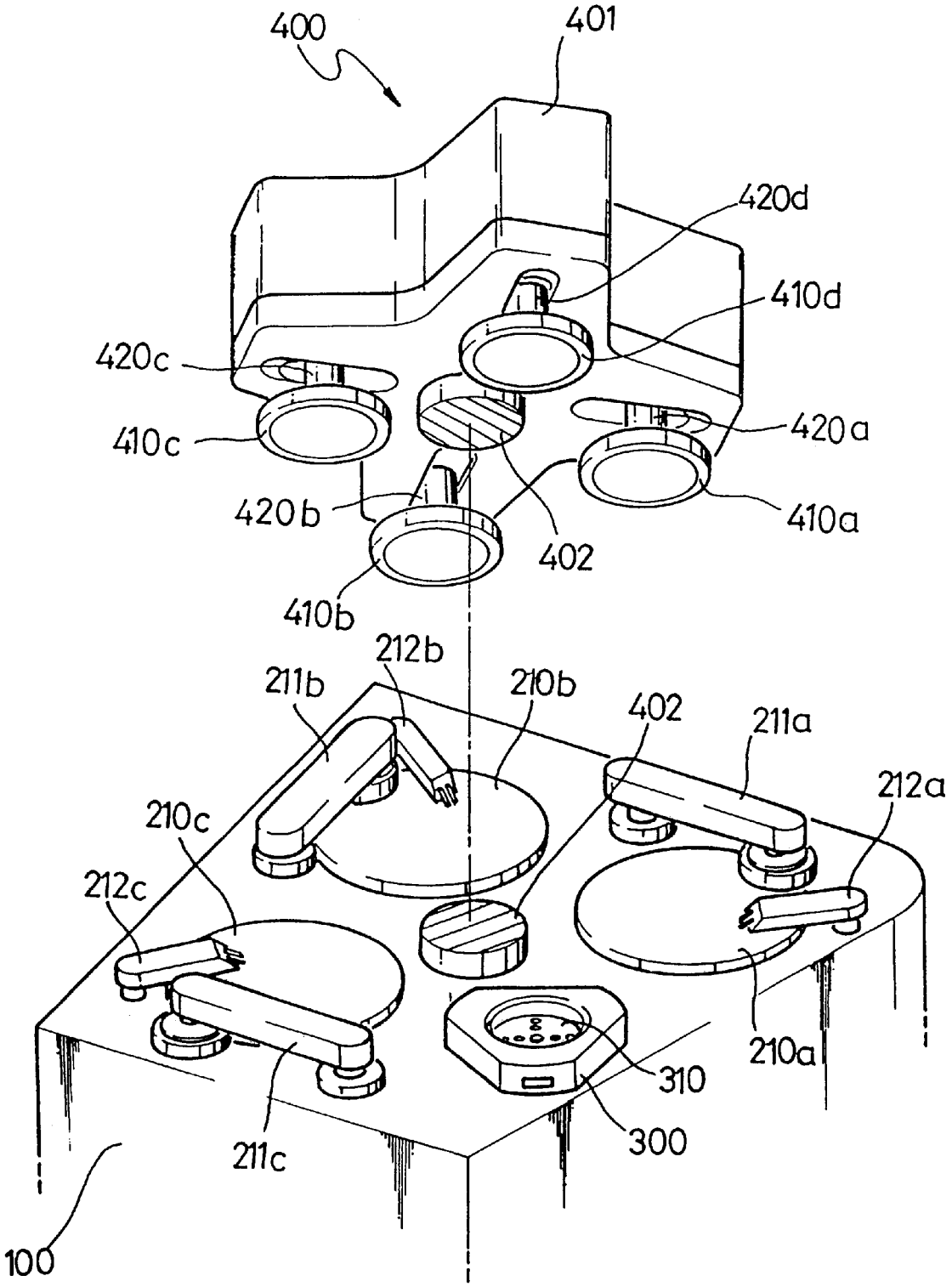
FIG.1 (PRIOR ART)
FIG. 1 is an exploded perspective view of a conventional chemical mechanical polishing (CMP) apparatus.
Figure 2:
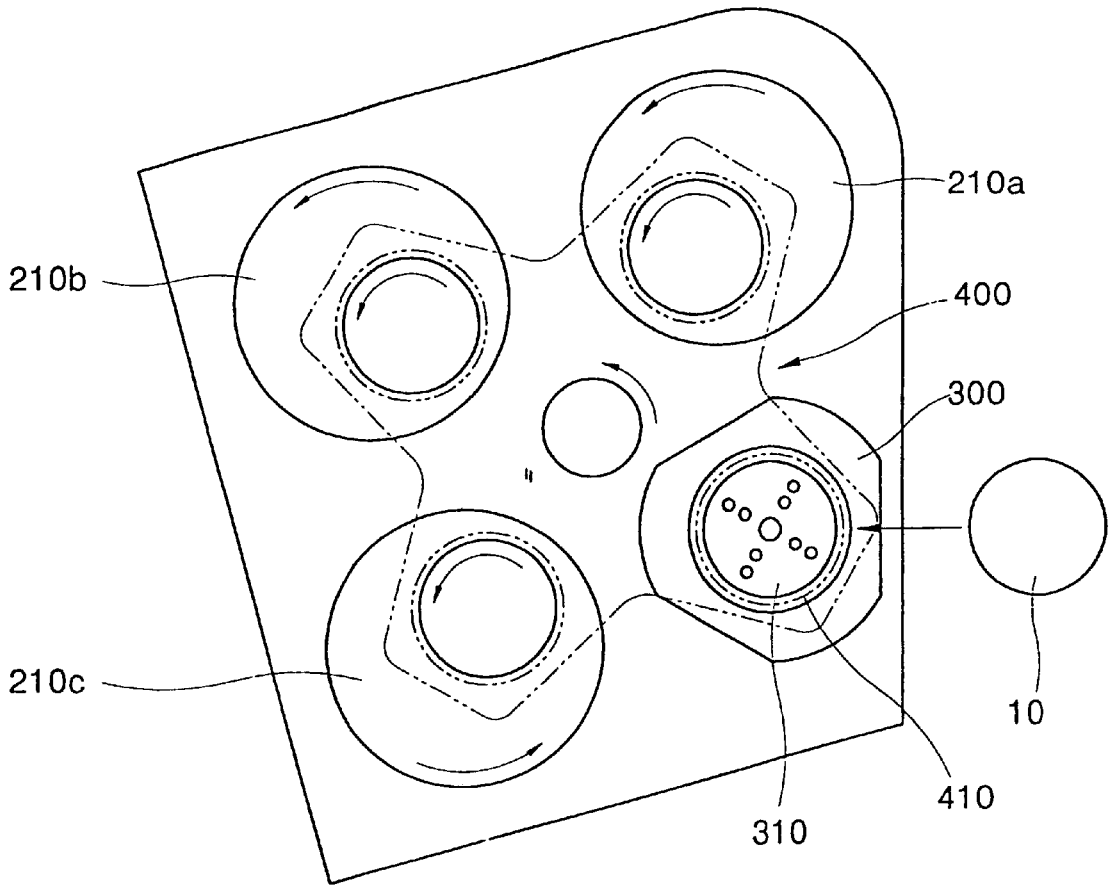
FIG.2 (PRIOR ART)
FIG. 2 is a top view of a bottom half of the conventional CMP apparatus, illustrating the movement of a wafer during polishing.
Figure 3:
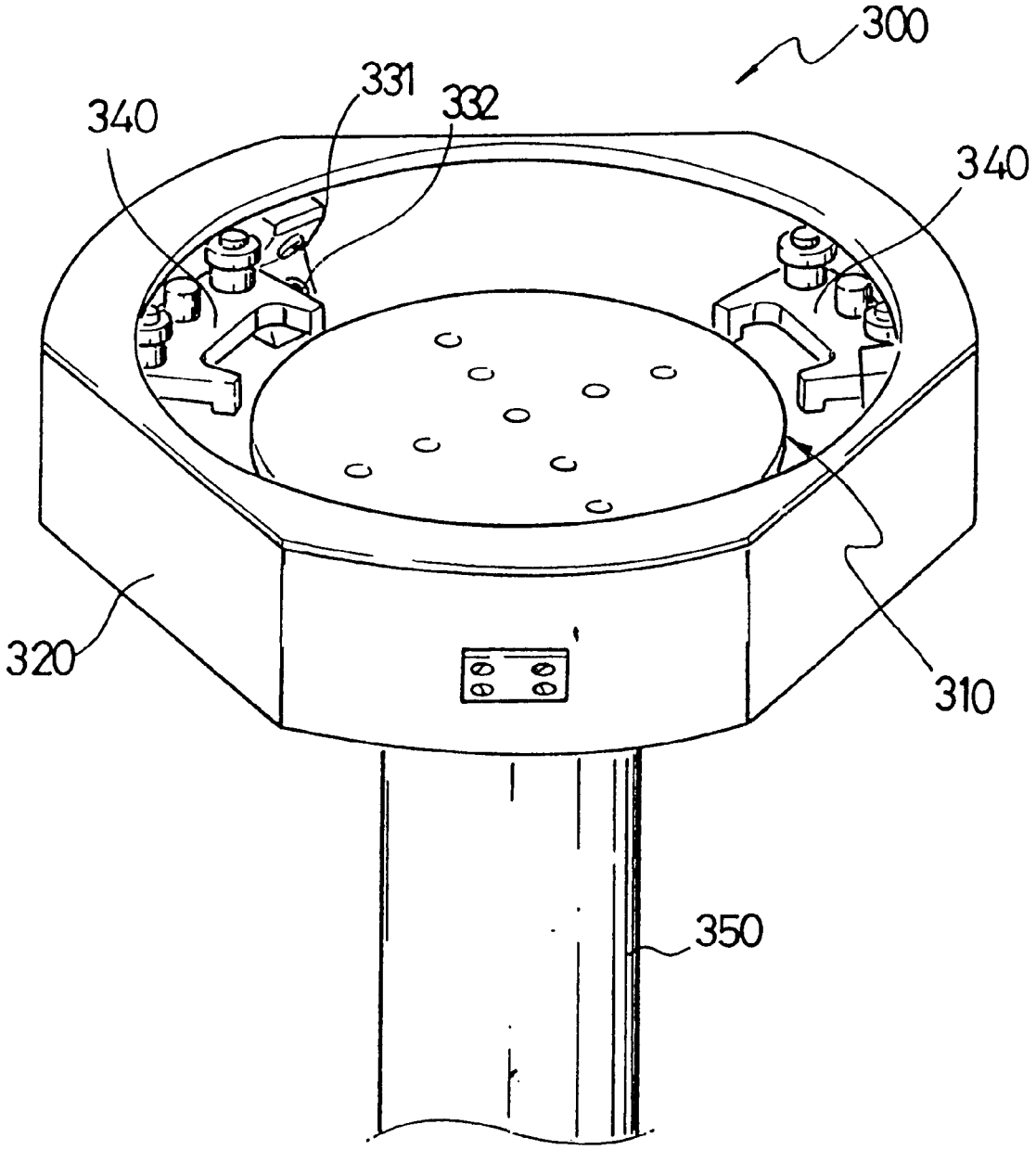
FIG.3 (PRIOR ART)
FIG. 3 is a perspective view of a load-cup of the conventional CMP apparatus.
Figure 4:
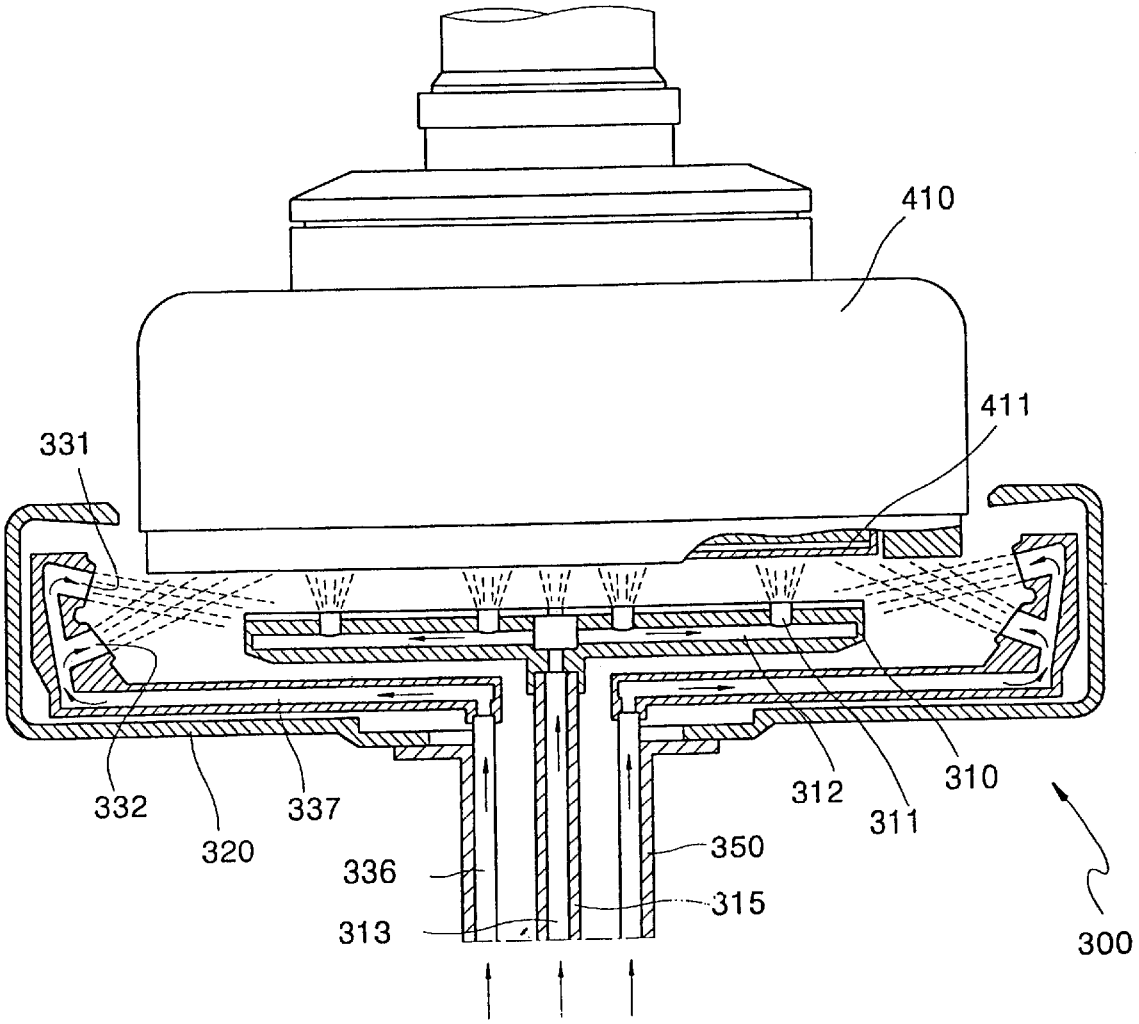
FIG.4 (PRIOR ART)
FIG. 4 is a cross-sectional view of the load-cup as it washes a polishing head.
Figure 5:
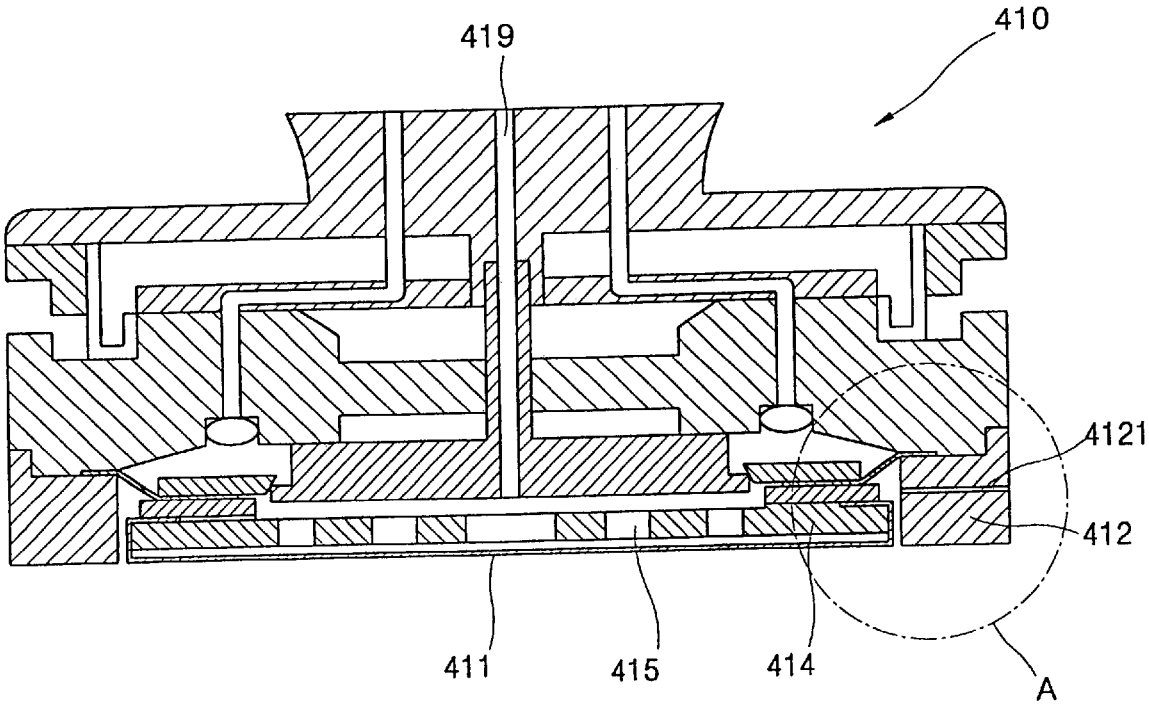
FIG.5 (PRIOR ART)
FIG. 5 is a cross-sectional view of the polishing head of the conventional CMP apparatus.
Figure 6:
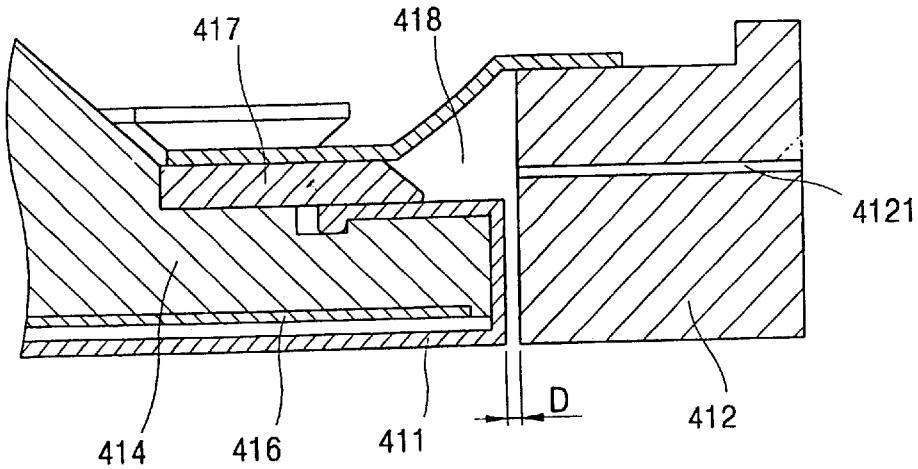
FIG.6 (PRIOR ART)
FIG. 6 is an enlarged view of a portion "A" of the polishing head encircled in FIG. 5.
Figure 7:
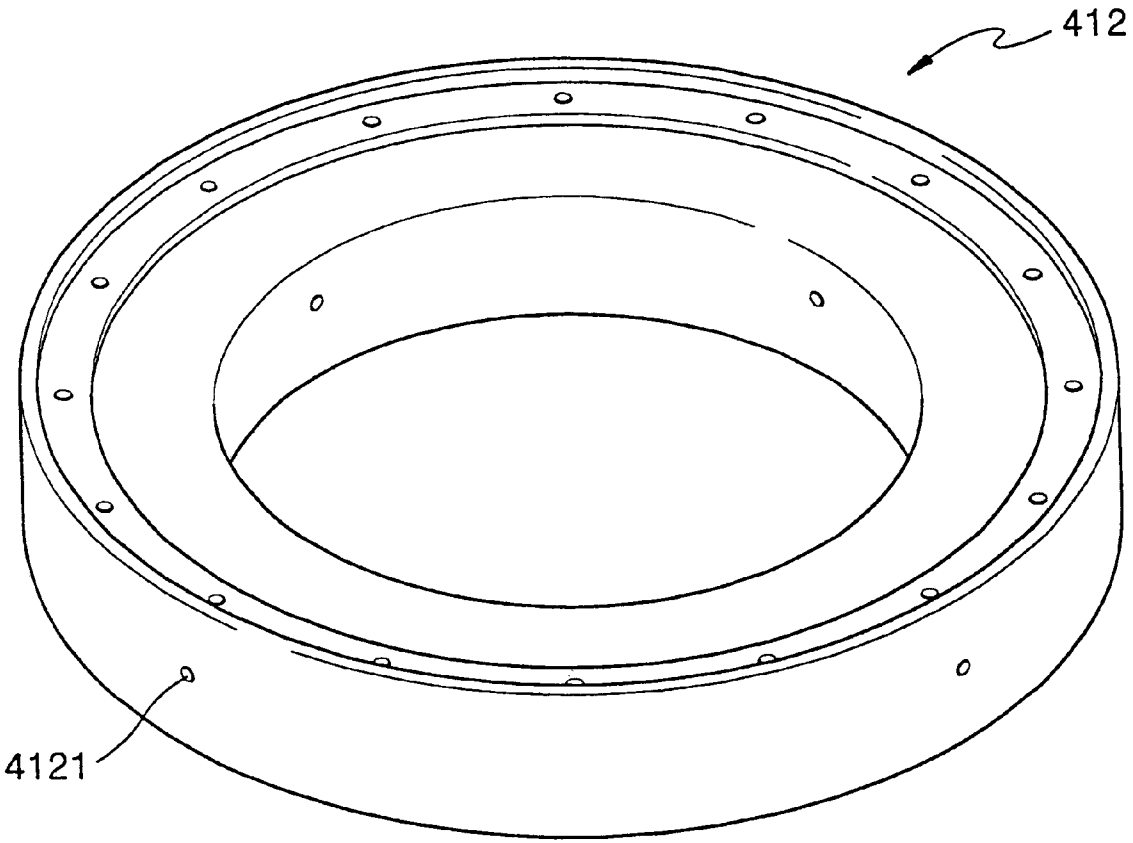
FIG.7 (PRIOR ART)
FIG. 7 is a perspective view of a retainer ring of the polishing head.
Figure 8:
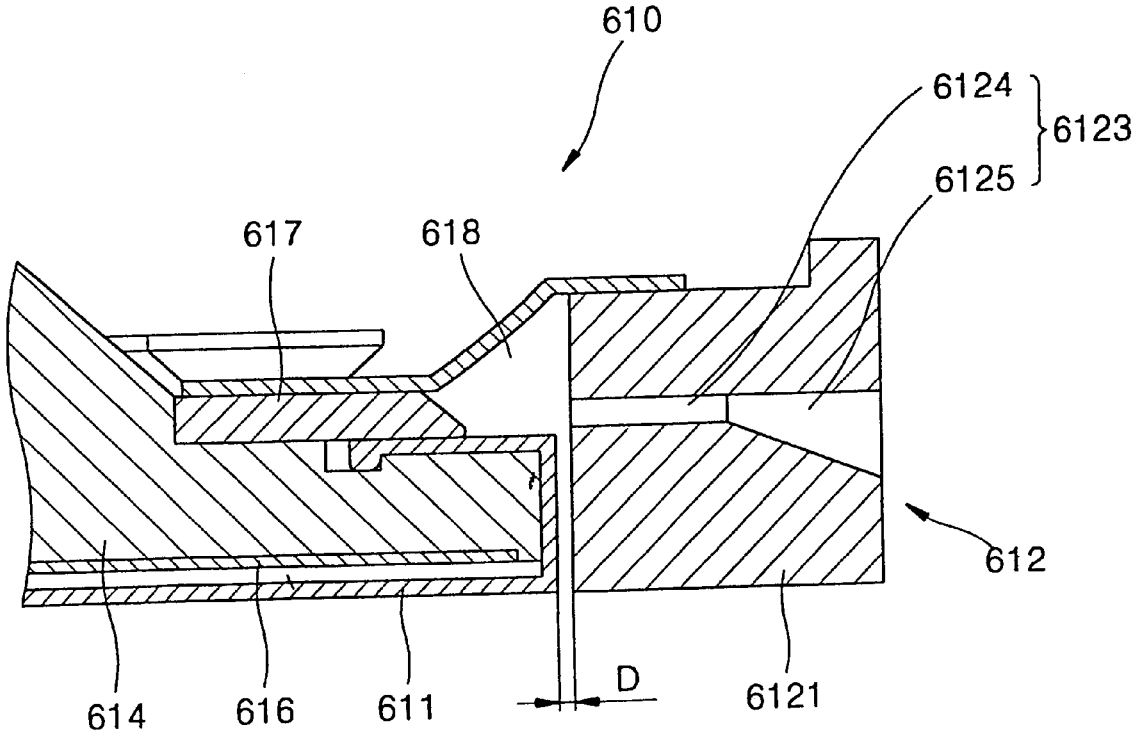
FIG. 8 is a cross-sectional view of part of a preferred embodiment of a polishing head having a retainer ring according to the present invention.
Figure 9:
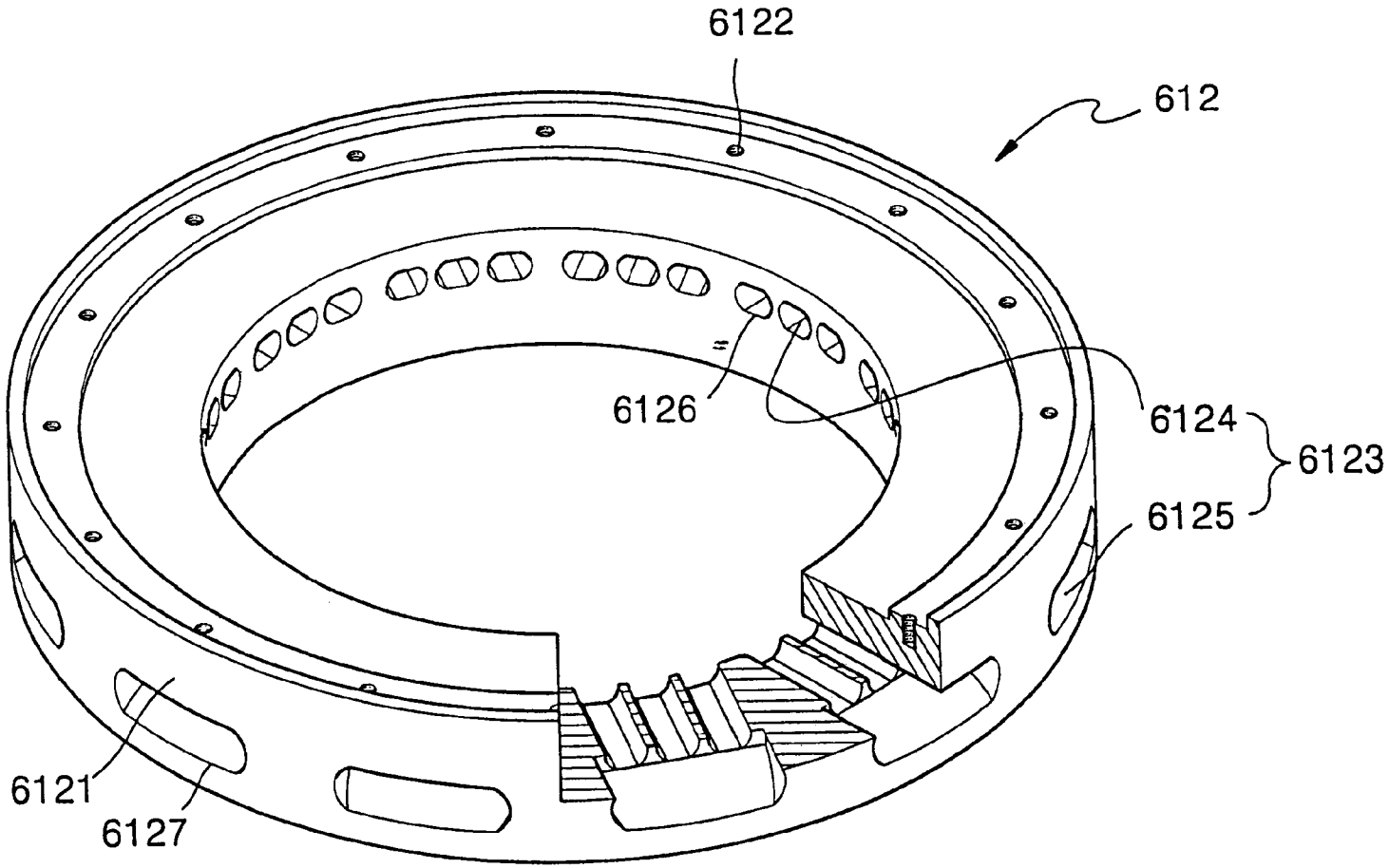
FIG. 9 is a perspective view of the retainer ring shown in FIG. 8.

Referring to FIGS. 8 and 9, the CMP apparatus of the present invention includes a polishing head 610 having a vacuum chuck for holding a wafer and a polishing pad which is rotated while a predetermined load is applied to the surface of the polishing pad. In particular, a vacuum line is provided in the polishing head 610 and a membrane support plate 614 having a plurality of pores communicating with the vacuum line is provided at the bottom of the polishing head 610. A membrane pad 616 is fixed to the bottom of the membrane support plate 614. The bottom of the membrane pad 616 and the outer surface of the membrane support plate 614 are surrounded by a membrane 611 made of a flexible material which directly contacts the wafer. The membrane 611 is fixed to the membrane support plate 614 by a membrane clamp 617. A retainer ring 612 disposed at the bottom peripheral portion of the polishing head 610, that is, at the perimeter of the membrane 611, prevents the wafer from moving about while it is being polished.

A narrow space 618 is present inside the polishing head 610 and contaminants may penetrate thereto through a narrow gap having a width (D) as taken between the outer surface of the membrane 611 and the inner surface of the retainer ring 612. If the contaminants induced into the space 618 accumulate there and dry up, the surface of a wafer could become scratched for reasons identical to those discussed with respect to the prior art.

To obviate this problem, contaminant outlets 6123 are provided in the retainer ring 612 for exhausting to the outside any contaminants, such as slurry debris or polished silicon particles, induced into the space 618 in the polishing head 610. When the wafer is polished, the polishing head 610 generally rotates counterclockwise. The contaminants induced into the space 618 are exhausted to the outside through the contaminant outlets 6123 by centrifugal force. The contaminant outlets 6123 also serve as a purge hole through which air passes when the wafer is vacuum-chucked to the membrane 611. Thus, it is not necessary to provide separate purge holes.

Each of the contaminant outlets 6123 extends between and is open to the radially innermost and outermost peripheral surfaces of an annular ring body 6121 of the retainer ring 612. Each contaminant outlet 6123 defines an inner opening 6126 at the inner peripheral surface of the ring body 6121, and an outer opening 6127 at the outer peripheral surface of the ring body 6121. Thus, the inner openings 6126 are exposed to the inner space 618 of the polishing head 610 and the outer openings 6127 are exposed to the outside of the polishing head 610. At least six contaminant outlets 6123 are provided at substantially equal angular intervals around the ring body 6121. FIG. 9 shows a retainer ring 612 having 12 such contaminant outlets 6123. Also, the sum of the widths of all the inner openings 6126 of the contaminant outlets 6123 (as taken in the circumferential direction of the inner peripheral surface of the ring body 6121) is preferably at least 30% of the circumference of the inner peripheral surface of the ring body 6121 itself. This ensures that the contaminants induced into the ring-shaped space 618 will be smoothly exhausted in all radial directions without accumulating at any part of the ring body 6121.

Reference numeral 6122 denotes screw holes, i.e., threaded holes, for facilitating the mounting of the retainer ring 612 to a body of the polishing head 610. Twelve screw holes 6122 are provided at equal intervals on the ring body 6121. If the screw holes 6122 and the contaminant outlets 6123 were located as vertically aligned, the strength of the retainer ring 612 would be compromised. To avoid this, the contaminant outlets 6123 are located between the screw holes 6122 with respect to the circumferential direction of the retainer ring 610. That is, the screw holes 6122 are offset from the contaminant outlets in the circumferential direction of the ring body 6121.

Also, the greater the total area of the contaminant outlets 6123, the weaker the retainer ring 612 becomes. In view of this, the inner and outer openings 6126 and 6127 preferably comprise slots elongate in the circumferential direction of the ring body 6121. Such slots facilitate a smooth exhaustion of contaminants while sustaining the strength of the retainer ring 612.

Each contaminant outlet 6123 is made up of a plurality of inner holes 6124, and a single outer hole 6125. More specifically, as shown in FIG. 9, each contaminant outlet 6123 preferably consists of three inner holes 6124 and one outer hole 6125 extending from the inner holes 6124 to the outer peripheral surface of the ring body 6121. The inner holes thus have a total cross-sectional area sufficient for allowing contaminants to pass therethrough without severely compromising the strength of the retainer ring 612.

Furthermore, the cross-sectional area of the outer opening 6127 is greater than that of the inner openings 6126. To this end, the bottom of the outer hole 6125 is sloped, extending downwardly away from the top surface of the ring body in the radial direction of the ring body. Thus, contaminants passing into the inner opening 6126 from the space 618 will flow freely to the outside of the polishing head 610 via the outer hole 6125.

Figure 10:
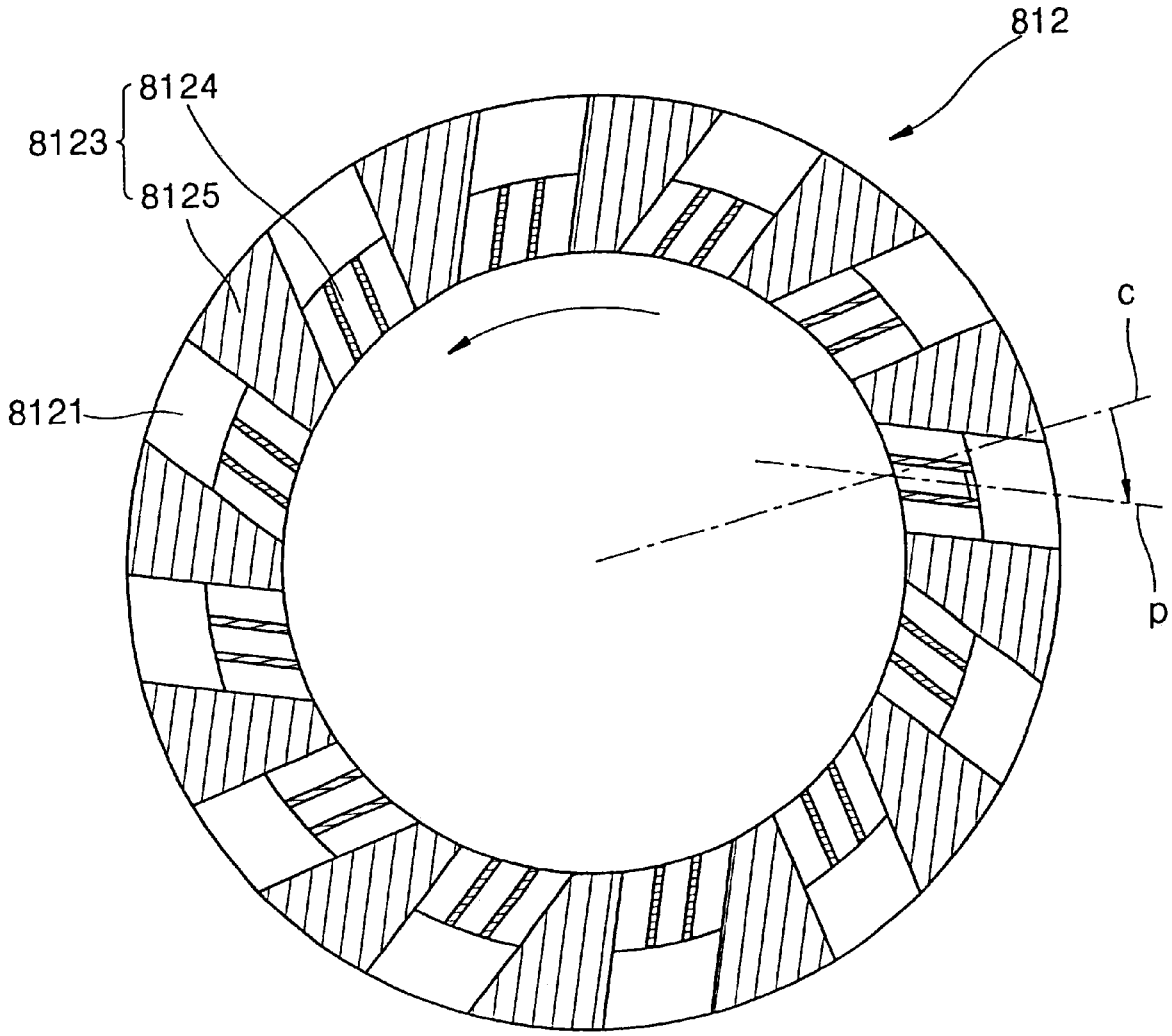
FIG. 10 is a horizontal cross-sectional view of another embodiment of the retainer ring according to the present invention.

FIG. 10 shows another embodiment of a retainer ring according to the present invention. As was mentioned above, when a wafer is polished, the polishing head generally rotates counterclockwise. Thus, the contaminants induced into the space inside the polishing head can be exhausted to the outside through a contaminant outlet by centrifugal force. However, the rotational speed of the contaminants may be lower than that of the retainer ring because the contaminants have fluidity. Even if the rotational speeds of the contaminants and the retainer ring are the same, their linear speeds differ. In other words, the speed of the retainer ring at its outer circumference is higher than the speed at its inner circumference. Accordingly, contaminants forced outwardly by centrifugal force rub against the inner wall of the retainer ring, which resistance impedes the exhausting of the contaminants.

To overcome such a potential drawback, as shown in FIG. 10, the contaminant outlets 8123 of the retainer ring 812 are inclined at a predetermined angle, with respect to the radial direction of the ring body 8121, in a direction opposite to the direction of rotation of the polishing head during polishing. In other words, each of the contaminant outlets 8123 extends longitudinally along line (p) from the radially innermost peripheral surface of the ring body 8121 to the radially outermost peripheral surface of the ring body 8121 at an angle with respect to a line (c) extending in the radial direction of the ring body through the center of an inner opening of the contaminant outlet. If the retainer ring is to rotate clockwise during polishing, the contaminant outlets 8123 are inclined in a counterclockwise direction.

With the contaminant outlets 8123 inclined in such a manner, the frictional resistance between the contaminants and the inner peripheral surface of the ring body 8121 is minimized, thereby facilitating the exhausting of the contaminants. Furthermore, each of the contaminant outlets 8123 may consist of a plurality of inner holes 8124 and an outer hole 8125 which is joined to the plurality of inner holes 8124, similarly to the embodiment described above.

Figure 11:
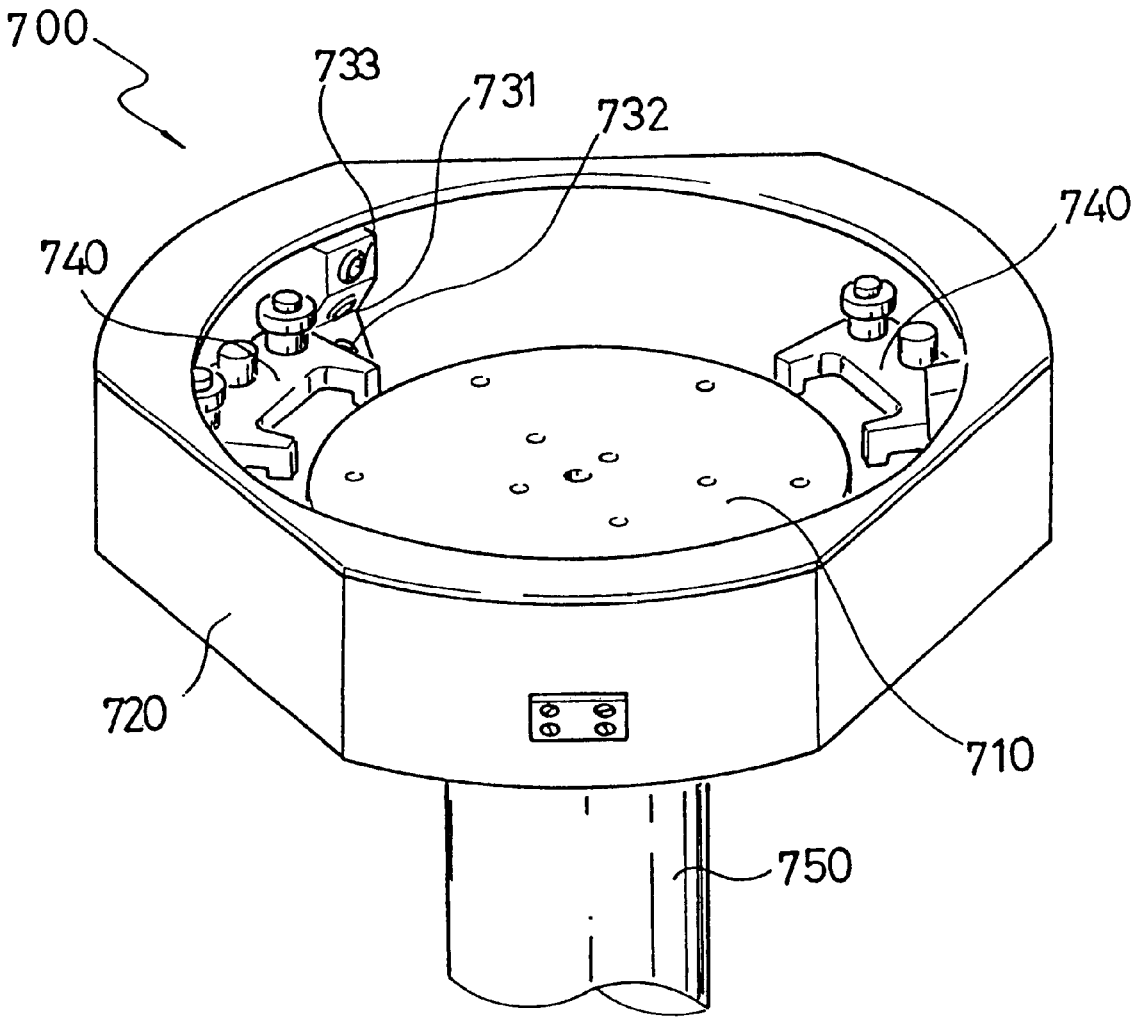
FIG. 11 is a perspective view of a load-cup of a CMP apparatus according to the present invention.
Figure 12:
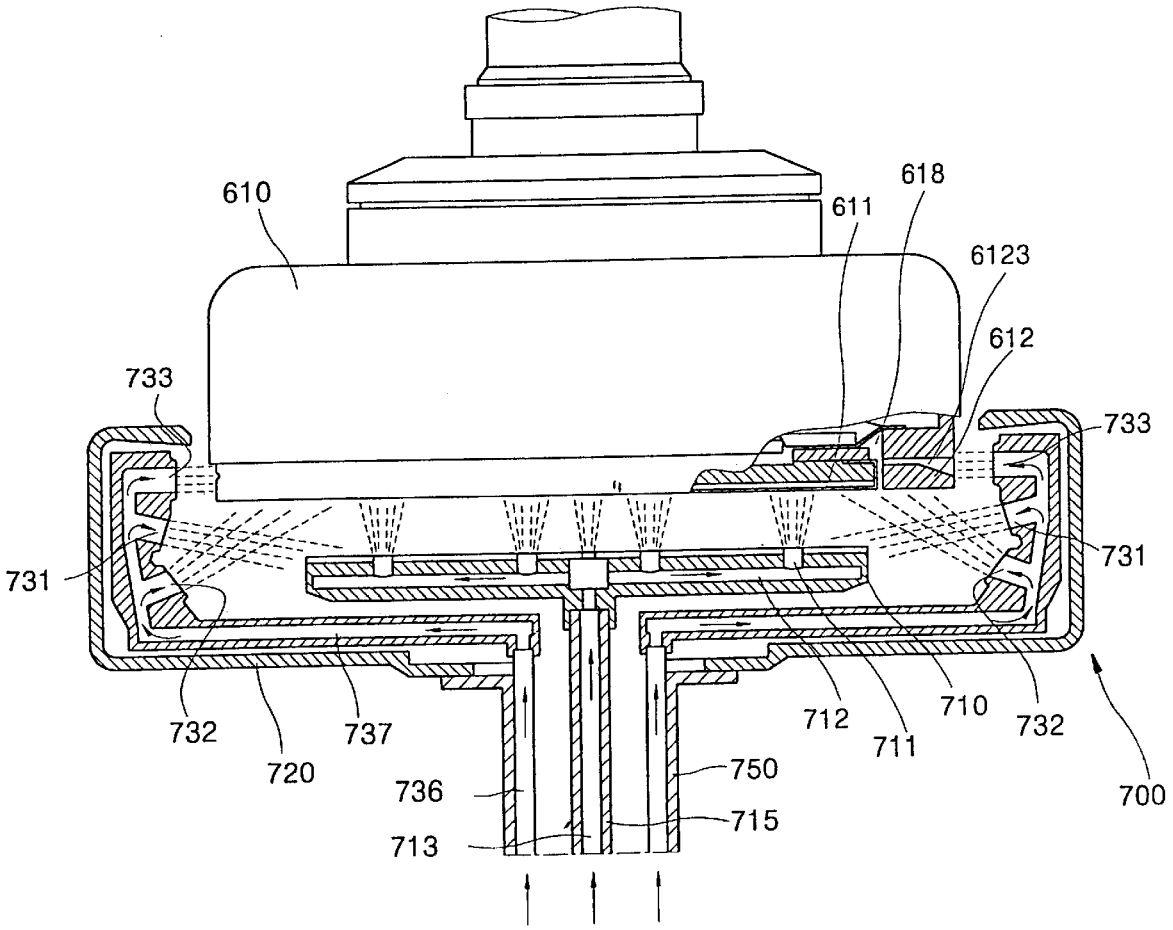
FIG. 12 is a partial vertical sectional view of a CMP apparatus according to the present invention, as taken through the load-cup and polishing head thereof.

FIGS. 11 and 12 show a load-cup 700 of a CMP apparatus according to the present invention. The load-cup 700 is characterized by having a third nozzle 733 for spraying deionized water through the contaminant outlets 6123 toward the inner space 618 of the polishing head 610.

More specifically, a load-cup 700 of the CMP apparatus is responsible for supporting wafers as they are loaded and unloaded, and for washing away contaminants, such as slurry debris or polished silicon particles, from the polishing head 610 and a pedestal 710 of the load-cup 700. With respect tot he latter function, the load-cup 700 includes a washing basin 720, and washing means comprising a first nozzle 731, a second nozzle 732 and a third nozzle 733 for spraying deionized water to wash away contaminants. The first nozzle 731 is oriented so as to spray deionized water toward the top surface of the pedestal 710 on which a wafer is situated, and the second nozzle 732 is oriented so as to spray deionized water toward a membrane 611 located at the bottom of the polishing head 610. The third nozzle 733, on the other hand, is oriented so as to spray deionized water through the contaminant outlet 6123s toward the space 618 formed in the polishing head 610.

In this embodiment, three sets of the first, second and third nozzles 731, 732 and 733 are spaced at equal angular intervals about the periphery of the pedestal 710. However, the number of the nozzles may vary appropriately. In particular, the number of third nozzles 237 may be designed for according to the size of the polishing head 610. Preferably, the number of third nozzles 733 corresponds to the number of contaminant outlets 7123 provided in the retainer ring 612.

Reference numeral 740 of FIG. 11 denotes a wafer aligner, which serves to guide wafers placed on the pedestal 710 into position.

The washing basin 720 is supported by a cylindrical support housing 750. A flexible hose 736 through which deionized water is supplied to the first, second and third nozzles 731, 732 and 733 is disposed within the support housing 750. The flexible hose 736 is connected to one end of a washing fluid channel 737 formed within the washing basin 720. The other end of the washing fluid channel 737 is connected to the first, second and third nozzles 731, 732 and 733.

Also, a plurality of spray orifices 711 may be formed in the pedestal 710 for spraying deionized water upwardly to wash the membrane 611. A lateral passageway 712 connected to the spray orifices 711 is provided in the pedestal 710. The lateral passageway 712 is connected to a vertical passageway 713 formed inside a tubular pedestal column 715 which supports the pedestal 710.

As described above, the CMP apparatus according to the present invention is provided with not only the retainer ring 612 having the contaminant outlets 6123 but also the washing means comprising the third nozzle 733 for supplying deionized water through the contaminant outlets 6123 and into the space 618 inside the polishing head 610. The deionized water sprayed by the third nozzle 733 prevents the contaminants induced into the space 618 from drying and thereby solidifying, and washes away the contaminants, thereby preventing the contaminants from accumulating in the space 618.

Figure 13:
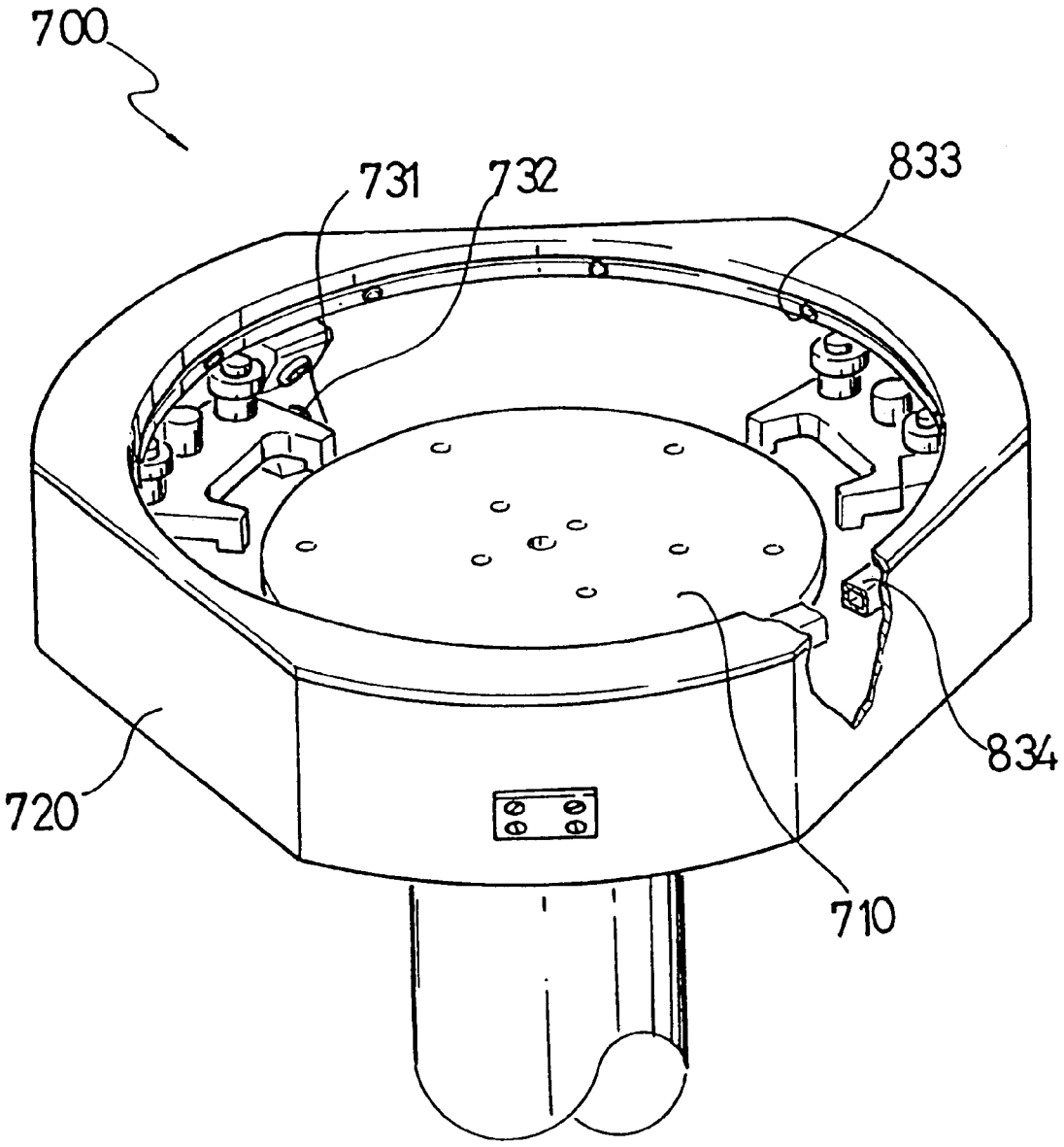
FIG. 13 is a perspective view of a load-cup of another embodiment of a CMP apparatus according to the present invention.

FIG. 13 shows a load-cup of another embodiment of a CMP apparatus according to the present invention. In this embodiment, the washing means comprises an annular deionized water supply line 834 extending along the inner surface of the washing basin 720 of the load-cup 700. The deionized water supply line 834 is connected to the washing fluid channel 737 shown in FIG. 12. A plurality of third nozzles 833 are provided in the deionized water supply line 834 as spaced apart by predetermined intervals. In this embodiment as well, the number of third nozzles 833 may be the same as that of the contaminant outlets 6123/8123. Moreover, as with the previous embodiment, three sets of the first nozzle and second nozzles 731 and 732 are spaced from one another along the periphery of the pedestal 710 at equal intervals.

This embodiment has the advantage in that the deionized water will be sprayed over a wider area of the space 618 where the contaminants are present.

Figure 14:
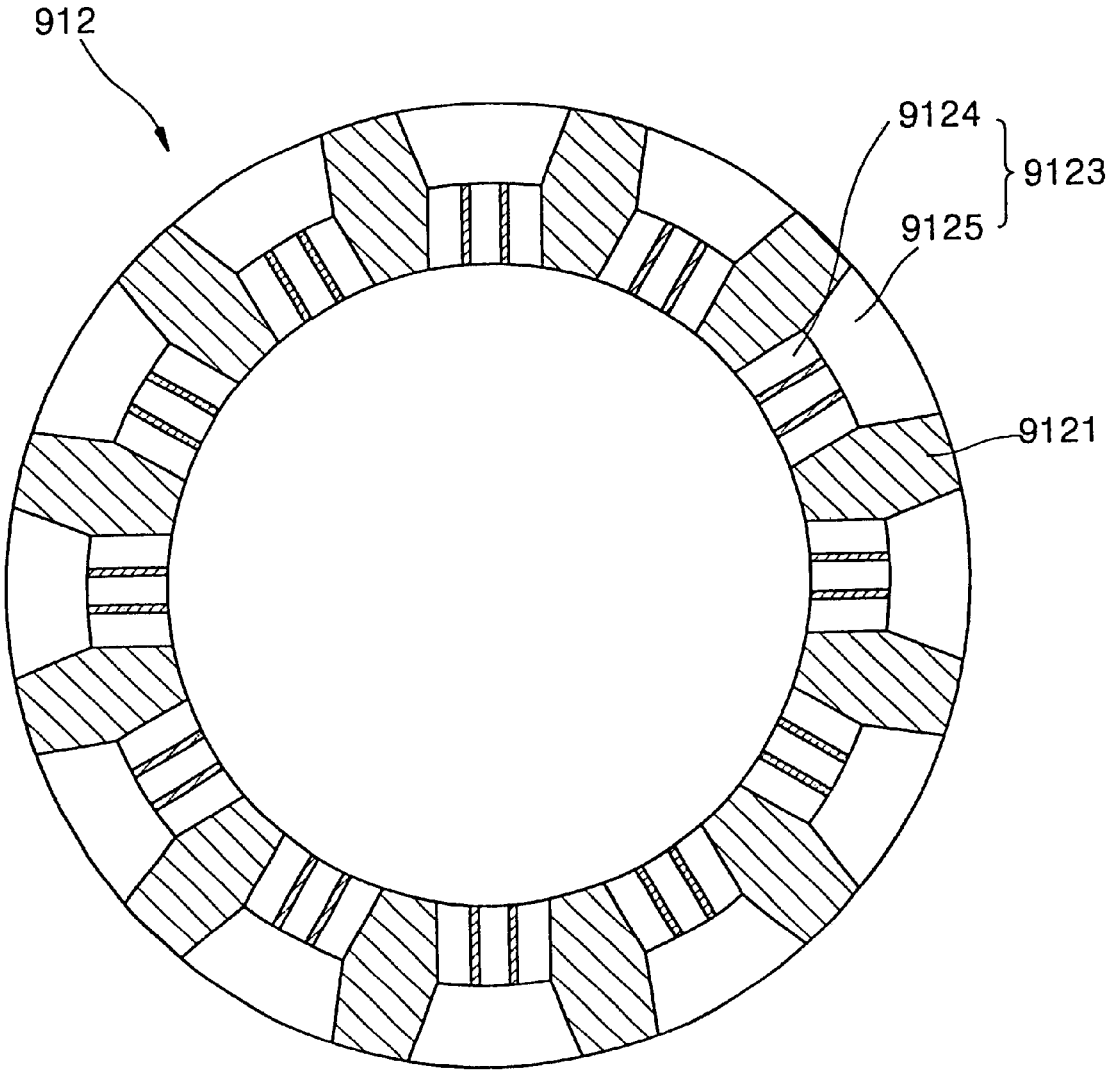
FIG. 14 is a horizontal cross-sectional view of another embodiment of a retainer ring according to the present invention.

FIG. 14 shows still another embodiment of a retainer ring 912 according to the present invention. In this embodiment, a plurality of contaminant outlets 9123 are provided in the retainer ring 912. Each of the plurality of contaminant outlets 9123 may include a plurality of inner holes 9124 and an outer hole 9125 which is joined to the plurality of inner holes 9124. The contaminant outlets 9213 are preferably configured such that the area of their outer opening, defined at the outer peripheral surface of the ring body 9121, is wider than that of an inner opening defined at the inner peripheral surface. To this end, the cross section of the outer hole 9125 increases in the radial direction of the ring body 9121.

This embodiment has the advantage that much more of the deionized water sprayed from the third nozzles (733 of FIG. 12) will flow into the inner space of the polishing head through the contaminant outlets 9123. Thus, the effectiveness by which the contaminants are washed away is enhanced.

Next, the effects of the present invention will be described with reference to FIGS. 15A through 18.

Figure 15A:
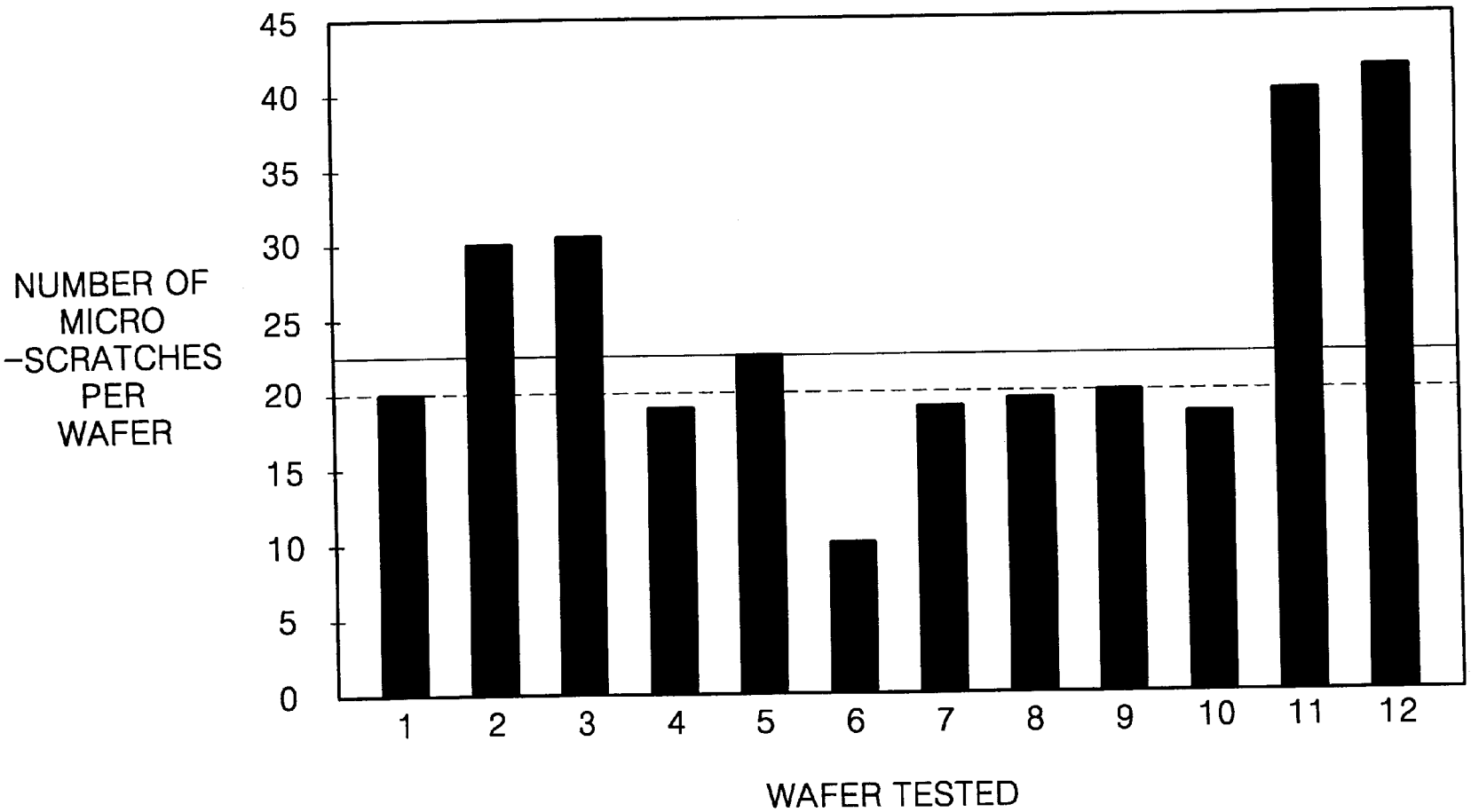
FIGS. 15A, 15B, 16A and 16B are graphs illustrating the tendencies of micro-scratches to occur on the surface of a wafer.
Figure 15B:
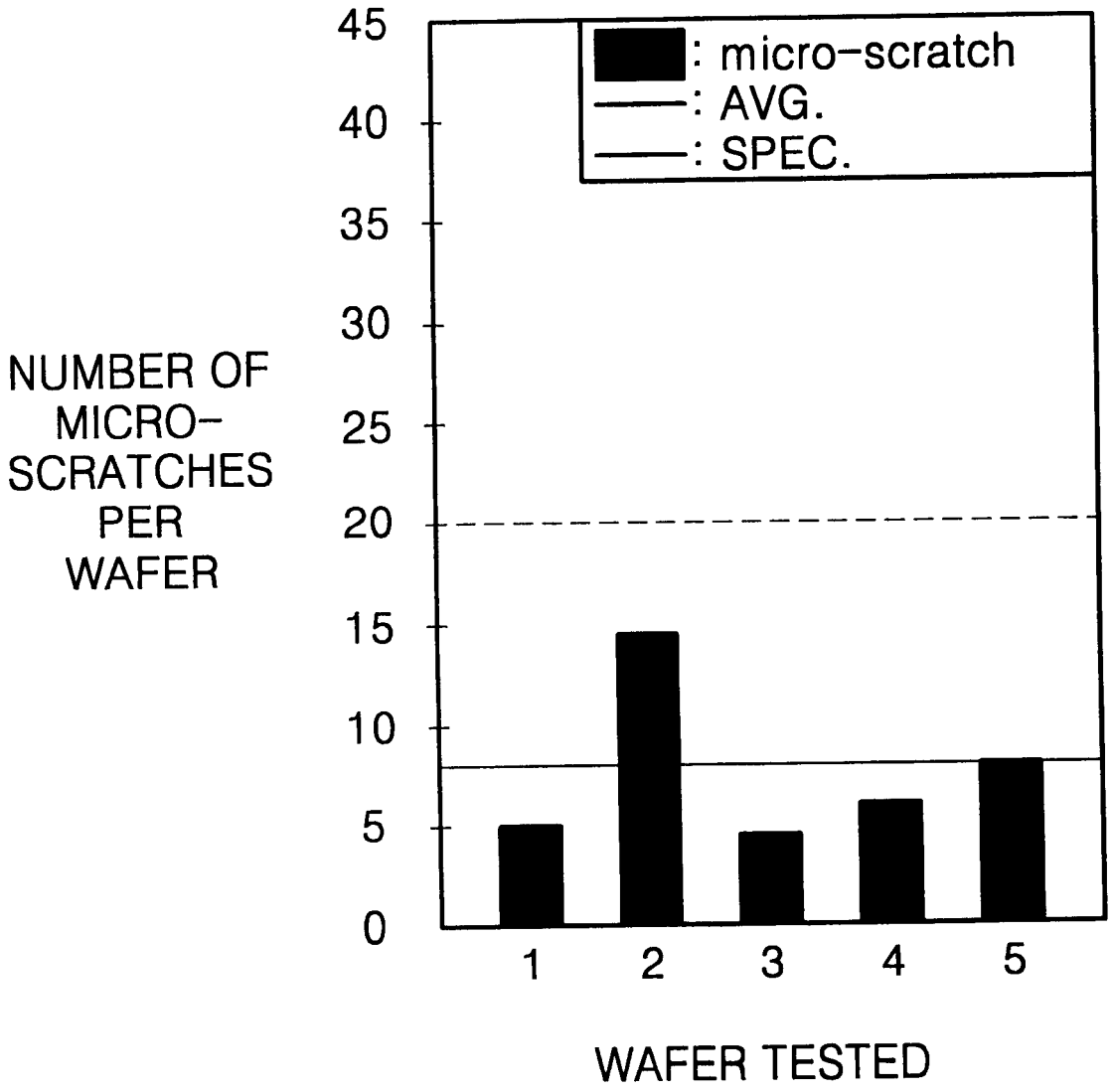

FIG. 15A illustrates the tendency of micro-scratches to occur on the surface of a wafer polished using a conventional CMP apparatus, and FIG. 15B illustrates the tendency of micro-scratches to occur on the surface of a wafer polished using a CMP apparatus according to the present invention. Numbers on the horizontal axes denote the number of the wafer tested, and numbers on the vertical axes denote the number of micro-scratches detected using a KLA instrument which is a commercially available wafer scanning tool made by KLA Instruments Corporation of Santa Clara, Calif.

Referring to FIGS. 15A and 15B, the conventional CMP apparatus often produces more than 20 micro-scratches in a wafer, 20 being the standard for mass production, but the average number of micro-scratches is about 22.7, which is higher than the standard number. On the other hand, the CMP apparatus of the present invention produces about only 7.4 micro-scratches in each wafer, which is significantly lower than the standard number.

Figure 16A:
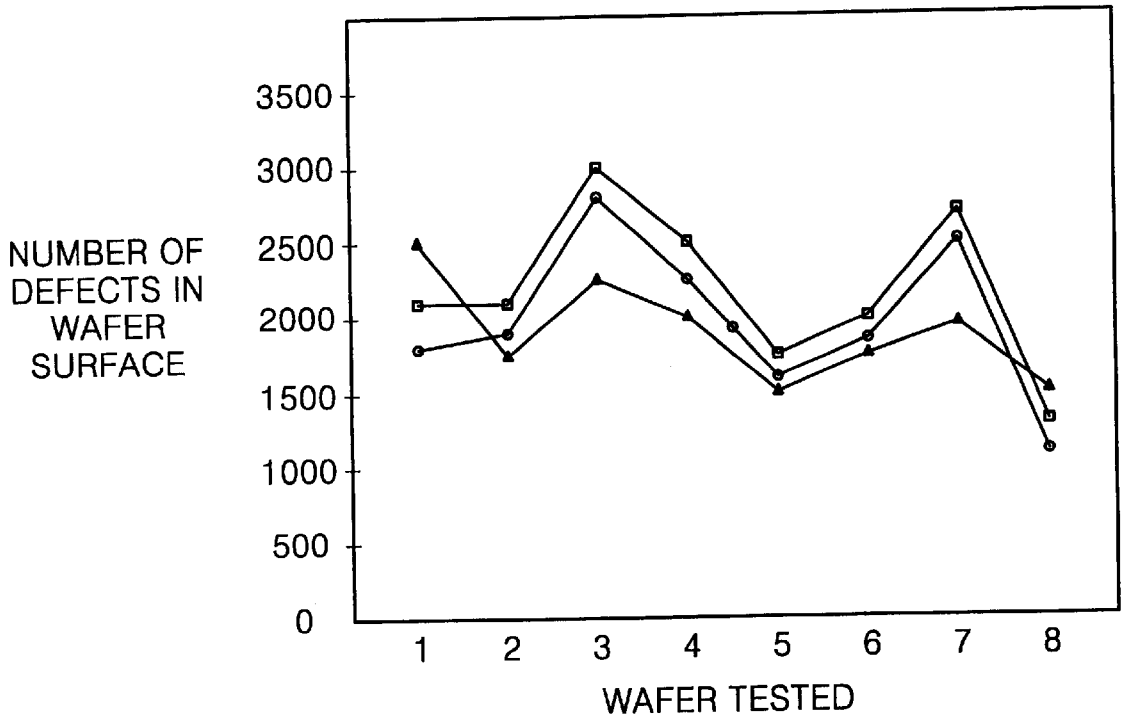
Figure 16B:
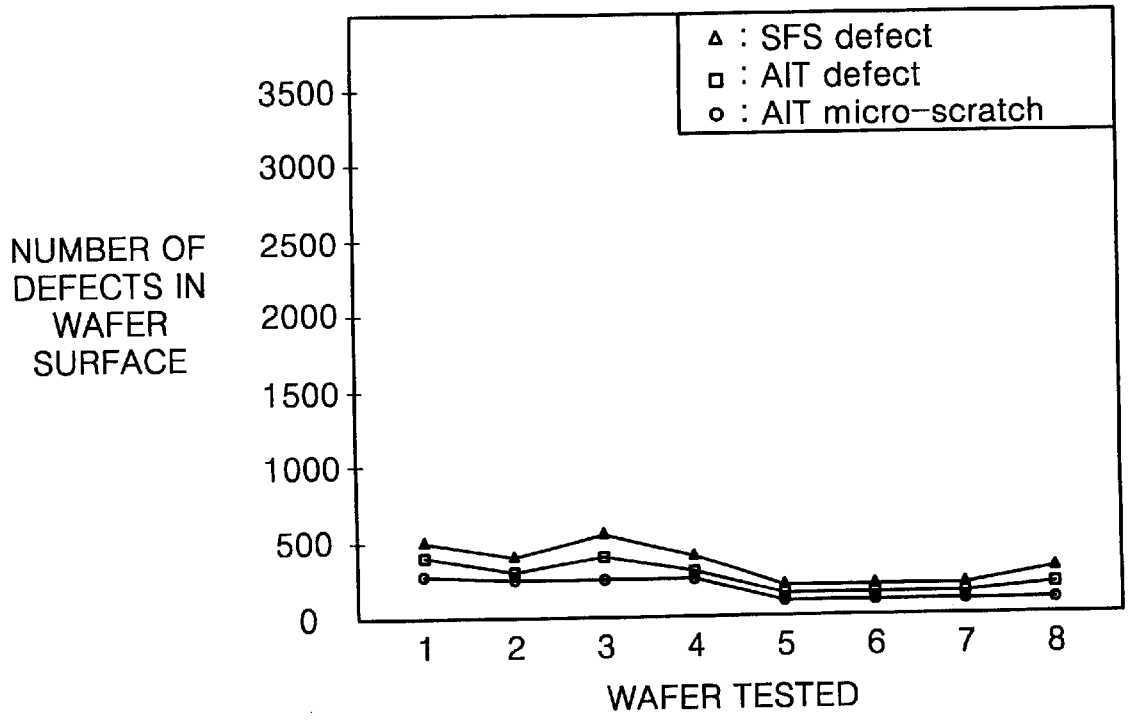

FIG. 16A illustrates the tendency of micro-scratches to occur on the surface of a wafer polished using a conventional CMP apparatus, and FIG. 16B illustrates the tendency of micro-scratches to occur on the surface of a wafer polished using a CMP apparatus according to the present invention. Numbers on the horizontal axes denote the number of the wafer tested and numbers on the vertical axes denote the number of micro-scratches detected in each wafer using an SFS or AIT system.

Referring to FIG. 16A, in the conventional art, the number of defects or micro-scratches in each wafer often ranges from 1500 to 3000, depending on the test instrument used. On the other hand, the technology of the present invention produces only about 35 to 250 defects or micro-scratches in each wafer.

Table 1 summarizes the data shown in FIGS. 15 and 16.

TABLE 1

Occurrence of defects and micro-scratches

| Test instrument | Prior art | Present invention | Reduction rate | Remarks |
|---|---|---|---|---|
| KLA | Average: 22.7<br>Maximum: 42<br>Minimum: 7 | Average: 7.4<br>Maximum: 14<br>Minimum: 4 | 67.4% | Micro-scratches in the surface of wafer for mass production |
| AIT | Average: 1967<br>Maximum: 2934<br>Minimum: 1232 | Average: 53<br>Maximum: 76<br>Minimum: 35 | 97.3% | Micro-scratches in the surface of wafer tested |
| SFS | Average: 1911<br>Maximum: 2503<br>Minimum: 1469 | Average: 173<br>Maximum: 256<br>Minimum: 134 | 90.9% | Overall defects at the surface of wafer tested |

As shown in Table 1, the number of micro-scratches occurring in the surface of a wafer used in the mass production of semiconductor devices was reduced by about 67.4% by the present invention. Also, other testing indicated that the present invention reduced the number of defects and micro-scratches occurring at the surface of a wafer by over 90% as compared with the prior art.

The CMP apparatus according to the present invention also provides the following advantages.

Figure 17:
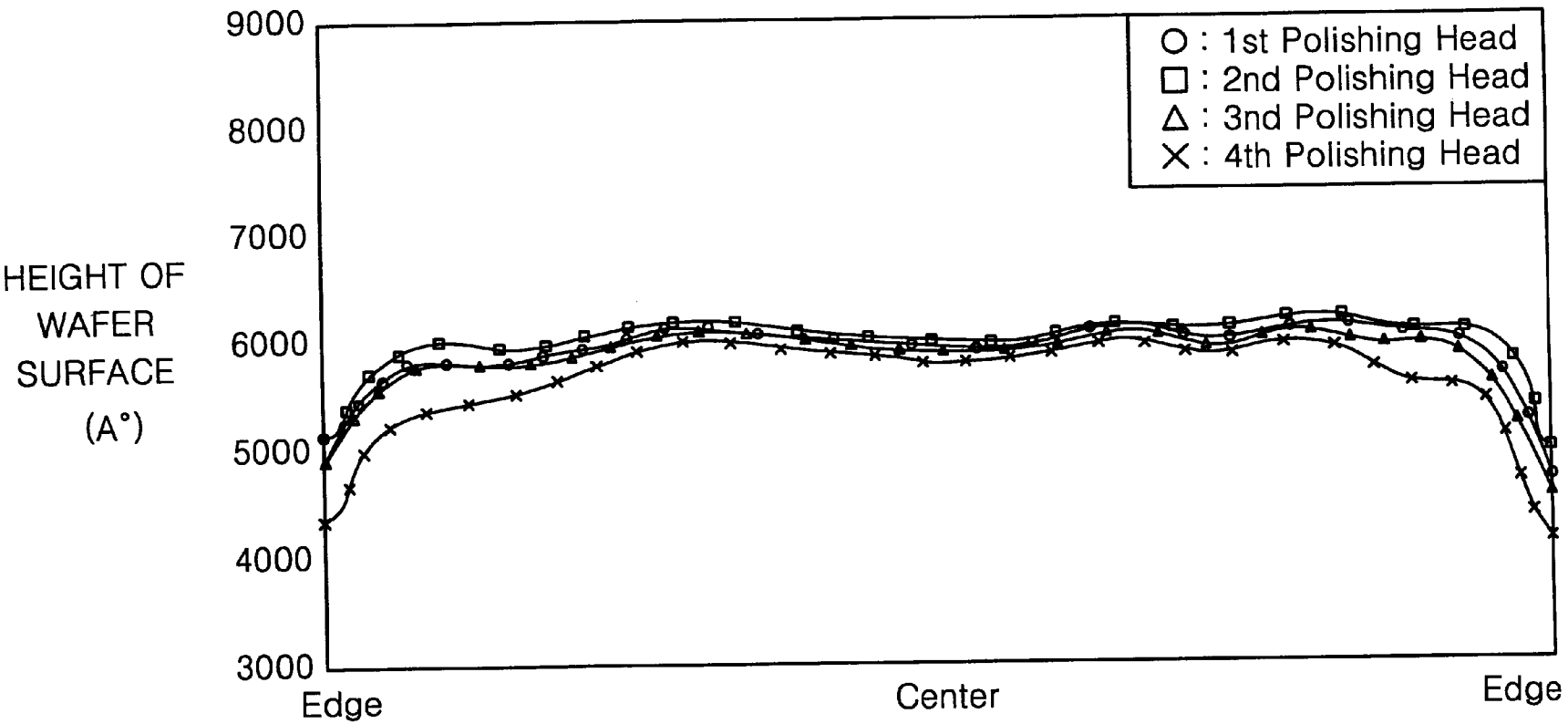
FIG. 17 is a graph illustrating the amount of polishing that occurs over the surface of a wafer when the conventional CMP apparatus is used.
Figure 18:
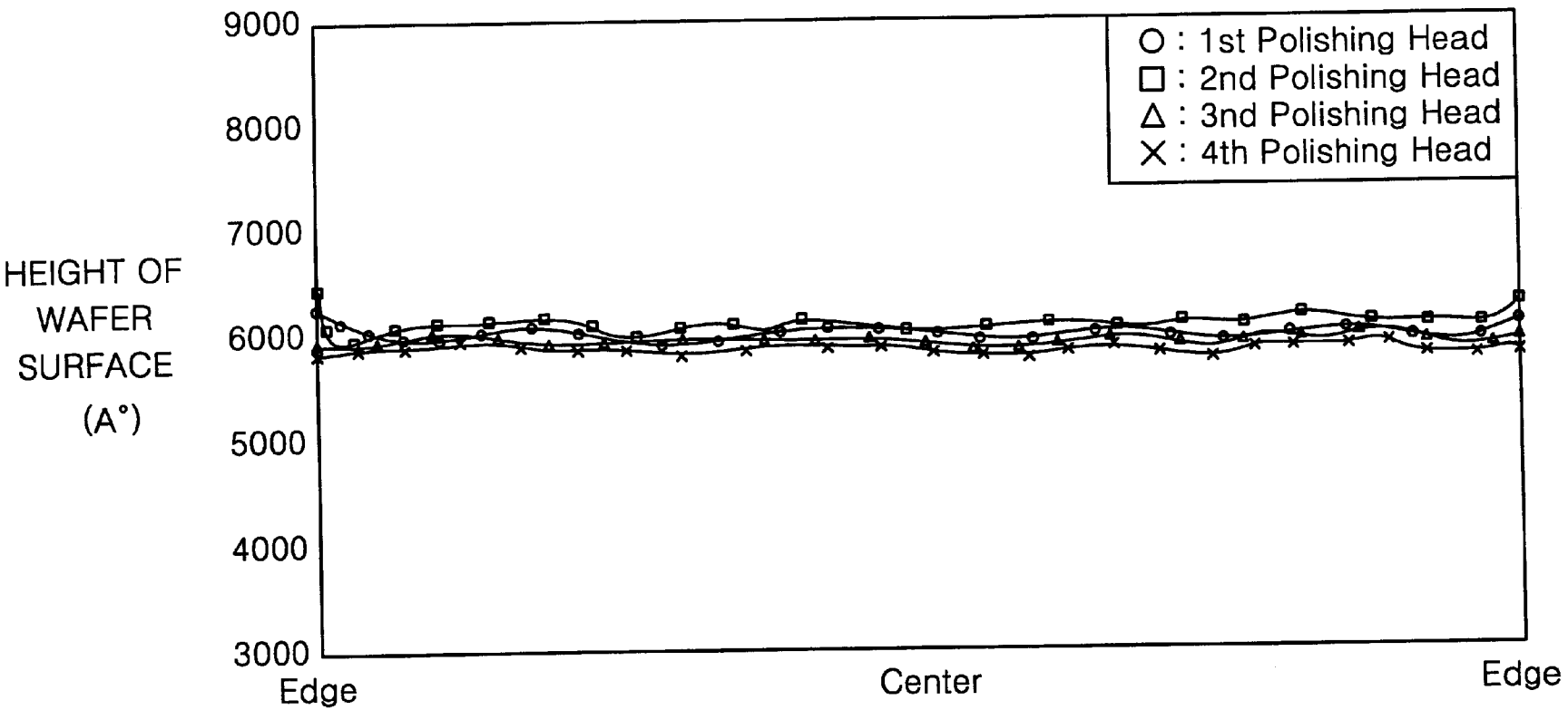
FIG. 18 is a graph illustrating the amount of polishing that occurs over the surface of a wafer when the CMP apparatus according to the present invention is used.

FIG. 17 is a graph illustrating the amount of polishing which is effected over the surface of a wafer when the conventional CMP apparatus is used, and FIG. 18 is a graph illustrating the amount of polishing which is effected over the surface of a wafer when the CMP apparatus according to the present invention is used. Here, the horizontal axis indicates the position on a wafer and the vertical axis indicates the amount of polishing.

Referring to FIG. 17, the amount of polishing at the edge of the wafer is less than that at the center when the conventional CMP apparatus is used because the polishing speed at the edge of the wafer is lower than that at the center. Thus, the uniformity of the wafer is poor.

However, as shown in FIG. 18, when the CMP apparatus of the present invention is used, the edge of the wafer is polished the same amount as the center. This occurs because the contaminant outlets are provided in the retainer ring of the polishing head. More specifically, slurry contained in the contaminants exhausted through the contaminant outlets flows along the outer peripheral surface of the retainer ring to the edge of the wafer. The amount of the slurry supplied to the wafer edge actually thereby increases such that the edge of the wafer is polished approximately the same amount as the center of the wafer.

Table 2 lists the uniformity of a wafer polished using the conventional CMP apparatus and the uniformity of a wafer polished using the CMP apparatus according to the present invention. In this table, uniformity is represented by a percentile (%) obtained by dividing the difference between the maximum surface height and the minimum surface height of a polished wafer by the average surface height.

TABLE 2

| | Uniformity of wafer surface (Unit: %) | |
|---|---|---|
| Classification | Prior art | Present invention |
| 1st polishing head | 4.66 | 1.11 |
| 2nd polishing head | 4.82 | 1.51 |
| 3rd polishing head | 4.88 | 1.70 |
| 4th polishing head | 7.22 | 2.03 |
| Average | 5.40 | 1.59 |

Referring to Table 2, whereas the average uniformity of a wafer polished by the conventional CMP apparatus was 5.40%, the average uniformity of a wafer polished by the CMP apparatus according to the present invention was 1.59. That is, the uniformity of the wafer surface is improved significantly by practicing the present invention.

As described above, according to the present invention, contaminants such as slurry debris or polished silicon particles which find their way into the polishing head are exhausted therefrom before accumulating and drying in the polishing head. Also, the contaminants within the polishing head are washed away by washing means comprising the third nozzles.

Thus, the scratching of the surface of a wafer due to the contaminants is minimized. Moreover, the surface of the wafer is polished uniformly. Accordingly, the present invention enhances the yield and reliability of semiconductor devices produced from the wafers.

Although the present invention has been described with reference to specific embodiments thereof, various changes in form and detail will become apparent to those skilled in the art will. Therefore, all such changes are within the true spirit and scope of the invention as defined by the appended claims.

What is claimed is:

1. A retainer ring of a polishing head of a chemical mechanical polishing apparatus, the retainer ring comprising:

an annular ring body having a radially innermost peripheral surface, a radially outermost peripheral surface, and at least six contaminant outlets extending between and open to said radially innermost and radially outermost peripheral surfaces of the ring body for exhausting contaminants induced into an inner space of the polishing head, said contaminant outlets being spaced apart from one another in a circumferential direction of the ring body at substantially equal angular intervals, and a sum of widths of the contaminant outlets as taken at said radially innermost peripheral surface in the circumferential direction thereof being at least 30% of a circumference of said radially innermost peripheral surface, and said ring body having a top surface and a plurality of threaded holes extending into said top surface for receiving screws which fix the retainer ring in place in the polishing head, the contaminant outlets being offset from the threaded holes in the circumferential direction of the ring body.

2. A retainer ring of a polishing head of a chemical mechanical polishing apparatus, the retainer ring comprising:

an annular ring body having a radially innermost peripheral surface, a radially outermost peripheral surface, and at least six contaminant outlets extending between and open to said radially innermost and radially outermost peripheral surfaces of the ring body for exhausting contaminants induced into an inner space of the polishing head, said contaminant outlets being spaced apart from one another in a circumferential direction of the ring body at substantially equal angular intervals, and a sum of widths of the contaminant outlets as taken at said radially innermost peripheral surface in the circumferential direction thereof being at least 30% of a circumference of said radially innermost peripheral surface, and said contaminant outlets defining inner openings at said radially innermost peripheral surface, and outer openings at said radially outermost peripheral surface, each of said inner and outer openings being in a form of a slot elongate in the circumferential direction of the ring body.

3. The retainer ring according to claim 2, wherein each of said outer openings has a greater area than that of each of said inner openings for each of said contaminant outlets.

4. A retainer ring of a polishing head of a chemical mechanical polishing apparatus, the retainer ring comprising:

an annular ring body having a radially innermost peripheral surface, a radially outermost peripheral surface, and at least six contaminant outlets extending between and open to said radially innermost and radially outermost peripheral surfaces of the ring body for exhausting contaminants induced into an inner space of the polishing head, said contaminant outlets being spaced apart from one another in a circumferential direction of the ring body at substantially equal angular intervals, and a sum of widths of the contaminant outlets as taken at said radially innermost peripheral surface in the circumferential direction thereof being at least 30% of a circumference of said radially innermost peripheral surface, and each of said contaminant outlets consisting of a plurality of inner holes spaced apart from one another in the circumferential direction of the ring body and extending from said radially innermost peripheral surface thereof, and a single outer hole to which said plurality of inner holes open into, said outer hole extending from said inner holes to said radially outermost peripheral surface of the ring body.

5. The retainer ring according to claim 4, wherein said outer hole has a bottom which inclines downwardly away from a top surface of said ring body in a radial direction from said inner holes and which is open thereto to said radially outermost peripheral surface of the ring body.

6. The retainer ring according to claim 4, wherein said outer hole has a cross-sectional area that increases in a radial direction of said ring body.

7. A retainer ring of a polishing head of a chemical mechanical polishing apparatus, the retainer ring comprising:

an annular ring body having a radially innermost peripheral surface, a radially outermost peripheral surface, and at least six contaminant outlets extending between and open to said radially innermost and radially outermost peripheral surfaces of the ring body for exhausting contaminants induced into an inner space of the polishing head, said contaminant outlets being spaced apart from one another in a circumferential direction of the ring body at substantially equal angular intervals, and a sum of widths of the contaminant outlets as taken at said radially innermost peripheral surface in the circumferential direction thereof being at least 30% of a circumference of said radially innermost peripheral surface, and each of said contaminant outlets extending longitudinally from said radially innermost peripheral surface of said ring body to said radially outermost peripheral surface of said ring body at an angle with respect to a line extending in a radial direction of the ring body through a center of an inner opening of the corresponding contaminant outlet at the radially innermost peripheral surface of the ring body.

8. A polishing head of a chemical mechanical polishing (CMP) apparatus, the polishing head comprising:

a vacuum line;

a membrane support plate disposed at a bottom of the polishing head, said membrane support plate having a plurality of pores communicating with said vacuum line;

a membrane pad fixed to a bottom of the membrane support plate;

a flexible membrane extending over a bottom of said membrane pad and an outer peripheral surface of said membrane support plate;

a membrane clamp fixing said flexible membrane to said membrane support plate; and a retainer ring fixed in place at a bottom peripheral portion of the polishing head, said retainer ring comprising an annular ring body having a radially innermost peripheral surface spaced from said flexible membrane at the outer peripheral surface of said membrane support plate such that a gap is defined between the retainer ring and the flexible membrane, the gap terminating at a space within the polishing head adjacent the radially innermost surface of the ring body, a radially outermost peripheral surface, and at least six contaminant outlets extending between and open to said radially innermost and radially outermost peripheral surfaces of the ring body for exhausting contaminants induced into said space within the polishing head, said contaminant outlets being spaced apart from one another in a circumferential direction of the ring body at substantially equal angular intervals, and a sum of widths of the contaminant outlets as taken at said radially innermost peripheral surface in the circumferential direction thereof being at least 30% of a circumference of said radially innermost peripheral surface, and said ring body having a top surface, and a plurality of threaded holes extending into said top surface and screws extending into said threaded holes to thereby fix the retainer ring in place in the polishing head, the contaminant outlets being offset from the threaded holes in the circumferential direction of the ring body.

9. A polishing head of a chemical mechanical polishing (CMP) apparatus, the polishing head comprising:

a vacuum line;

a membrane support plate disposed at a bottom of the polishing head, said membrane support plate having a plurality of pores communicating with said vacuum line;

a membrane pad fixed to a bottom of the membrane support plate;

a flexible membrane extending over a bottom of said membrane pad and an outer peripheral surface of said membrane support plate;

a membrane clamp fixing said flexible membrane to said membrane support plate; and a retainer ring fixed in place at a bottom peripheral portion of the polishing head, said retainer ring comprising an annular ring body having a radially innermost peripheral surface spaced from said flexible membrane at the outer peripheral surface of said membrane support plate such that a gap is defined between the retainer ring and the flexible membrane, the gap terminating at a space within the polishing head adjacent the radially innermost surface of the ring body, a radially outermost peripheral surface, and at least six contaminant outlets extending between and open to said radially innermost and radially outermost peripheral surfaces of the ring body for exhausting contaminants induced into said space within the polishing head, said contaminant outlets being spaced apart from one another in a circumferential direction of the ring body at substantially equal angular intervals, and a sum of widths of the contaminant outlets as taken at said radially innermost peripheral surface in the circumferential direction thereof being at least 30% of a circumference of said radially innermost peripheral surface, and said contaminant outlets defining inner openings at said radially innermost peripheral surface, and outer openings at said radially outermost peripheral surface, each of said inner and outer openings being in a form of a slot elongate in the circumferential direction of the ring body.

10. The polishing head according to claim 9, wherein each of said outer openings has a greater area than that of each of said inner openings for each of said contaminant outlets.

11. A polishing head of a chemical mechanical polishing (CMP) apparatus, the polishing head comprising:

a vacuum line;

a membrane support plate disposed at a bottom of the polishing head, said membrane support plate having a plurality of pores communicating with said vacuum line;

a membrane pad fixed to a bottom of the membrane support plate;

a flexible membrane extending over a bottom of said membrane pad and an outer peripheral surface of said membrane support plate;

a membrane clamp fixing said flexible membrane to said membrane support plate; and a retainer ring fixed in place at a bottom peripheral portion of the polishing head, said retainer ring comprising an annular ring body having a radially innermost peripheral surface spaced from said flexible membrane at the outer peripheral surface of said membrane support plate such that a gap is defined between the retainer ring and the flexible membrane, the gap terminating at a space within the polishing head adjacent the radially innermost surface of the ring body, a radially outermost peripheral surface, and at least six contaminant outlets extending between and open to said radially innermost and radially outermost peripheral surfaces of the ring body for exhausting contaminants induced into said space within the polishing head, said contaminant outlets being spaced apart from one another in a circumferential direction of the ring body at substantially equal angular intervals, and a sum of widths of the contaminant outlets as taken at said radially innermost peripheral surface in the circumferential direction thereof being at least 30% of a circumference of said radially innermost peripheral surface, and each of said contaminant outlets consisting of a plurality of inner holes spaced apart from one another in the circumferential direction of the ring body and extending from said radially innermost peripheral surface thereof, and a single outer hole to which said plurality of inner holes open into, said outer hole extending from said inner holes to said radially outermost peripheral surface of the ring body.

12. The polishing head according to claim 11, wherein said outer hole has a bottom which inclines downwardly away from a top surface of said ring body in a radial direction from said inner holes and which is open thereto to said radially outermost peripheral surface of the ring body.

13. The polishing head according to claim 11, wherein said outer hole has a cross-sectional area that increases in a radial direction of said ring body.

14. A polishing head of a chemical mechanical polishing (CMP) apparatus, the polishing head comprising:

a vacuum line;

a membrane support plate disposed at a bottom of the polishing head, said membrane support plate having a plurality of pores communicating with said vacuum line;

a membrane pad fixed to a bottom of the membrane support plate;

a flexible membrane extending over a bottom of said membrane pad and an outer peripheral surface of said membrane support plate;

a membrane clamp fixing said flexible membrane to said membrane support plate; and a retainer ring fixed in place at a bottom peripheral portion of the polishing head, said retainer ring comprising an annular ring body having a radially innermost peripheral surface spaced from said flexible membrane at the outer peripheral surface of said membrane support plate such that a gap is defined between the retainer ring and the flexible membrane, the gap terminating at a space within the polishing head adjacent the radially innermost surface of the ring body, a radially outermost peripheral surface, and at least six contaminant outlets extending between and open to said radially innermost and radially outermost peripheral surfaces of the ring body for exhausting contaminants induced into said space within the polishing head, said contaminant outlets being spaced apart from one another in a circumferential direction of the ring body at substantially equal angular intervals, and a sum of widths of the contaminant outlets as taken at said radially innermost peripheral surface in the circumferential direction thereof being at least 30% of a circumference of said radially innermost peripheral surface, and each of said contaminant outlets extending longitudinally from said radially innermost peripheral surface of said ring body to said radially outermost peripheral surface of said ring body at an angle with respect to a line extending in a radial direction of the ring body through a center of an inner opening of the corresponding contaminant outlet at the radially innermost peripheral surface of the ring body.

* * * * *